US009852679B2

(12) United States Patent
Oh et al.

(10) Patent No.: US 9,852,679 B2
(45) Date of Patent: Dec. 26, 2017

(54) DISPLAY DRIVING DEVICE, DISPLAY DEVICE AND OPERATING METHOD THEREOF

(71) Applicant: SAMSUNG ELECTRONICS CO., LTD., Suwon-si (KR)

(72) Inventors: Min-seok Oh, Seoul (KR); Chi-ho Cha, Suwon-si (KR); Myeong-jun Chae, Seoul (KR); Suk-gyun Lim, Bucheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/837,027

(22) Filed: Aug. 27, 2015

(65) Prior Publication Data

US 2016/0133178 A1 May 12, 2016

(30) Foreign Application Priority Data

Nov. 11, 2014 (KR) ..... 10-2014-0156245

(51) Int. Cl.
*G09G 3/20* (2006.01)

(52) U.S. Cl.
CPC ... *G09G 3/2092* (2013.01); *G09G 2310/0291* (2013.01); *G09G 2310/08* (2013.01); *G09G 2352/00* (2013.01); *G09G 2370/08* (2013.01)

(58) Field of Classification Search
CPC .. G09G 2310/08; G09G 5/18; G09G 2370/08; G09G 3/3666
(Continued)

(56) References Cited

U.S. PATENT DOCUMENTS 6,624,801 B2 * 9/2003 Moriyama ..... G09G 3/36 345/100
8,004,486 B2 8/2011 Nam et al.
(Continued)

FOREIGN PATENT DOCUMENTS

KR 1998-0010735 A 4/1998
KR 10-2007-0078949 A 8/2007
(Continued)

OTHER PUBLICATIONS

Communication dated Oct. 28, 2016 issued by Korean Intellectual Property Office in counterpart Korean Application No. 10-2014-0156245.

*Primary Examiner* — Stephen Sherman
(74) *Attorney, Agent, or Firm* — Sughrue Mion, PLLC

(57) ABSTRACT

A display device is provided. The display device includes a display panel including a plurality of pixel arrangement areas, a data driving unit including a plurality of source drivers, and a timing controller configured to process data that is input from an external device and configured to generate output data. Each of the plurality of pixel arrangement areas includes a plurality of pixels arranged in areas in which a plurality of gate lines intersect a plurality of data lines. Each of the plurality of source drivers outputs display data to data lines of its corresponding pixels. The timing controller classifies the plurality of pixel arrangement areas based on a distance between the timing controller and each of the plurality of pixel arrangement areas, and transmits the output data to the data driving unit at at least two transmission speeds based on the classification.

20 Claims, 19 Drawing Sheets

(58) Field of Classification Search
USPC ..... 345/99, 103
See application file for complete search history.

(56) References Cited

U.S. PATENT DOCUMENTS

| | | | | |
|---|---|---|---|---|
| 8,264,473 | B2 | 9/2012 | Kota | |
| 8,289,258 | B2 | 10/2012 | Song et al. | |
| 8,305,366 | B2 | 11/2012 | Huang | |
| 8,405,785 | B1 | 3/2013 | Auld et al. | |
| 8,446,400 | B2 | 5/2013 | Wu et al. | |
| 8,471,981 | B2 | 6/2013 | Kim et al. | |
| 8,502,927 | B2 | 8/2013 | Chen et al. | |
| 8,547,317 | B2 | 10/2013 | Lee | |
| 8,564,522 | B2 | 10/2013 | Kim | |
| 8,674,924 | B2 | 3/2014 | Nose | |
| 2003/0122761 | A1* | 7/2003 | Hong | G09G 3/2011 345/89 |
| 2005/0206798 | A1* | 9/2005 | Kim | G02F 1/136286 349/54 |
| 2007/0195030 | A1 | 8/2007 | Huang et al. | |
| 2007/0211010 | A1* | 9/2007 | Lin | G09G 3/2092 345/99 |
| 2009/0096771 | A1* | 4/2009 | Lee | G09G 3/3611 345/204 |
| 2009/0274241 | A1 | 11/2009 | Tsao et al. | |
| 2010/0225620 | A1 | 9/2010 | Lee | |
| 2010/0283777 | A1* | 11/2010 | Sang | G09G 3/3696 345/212 |
| 2012/0044236 | A1 | 2/2012 | Nam et al. | |
| 2014/0062983 | A1 | 3/2014 | Kim et al. | |

FOREIGN PATENT DOCUMENTS

| | | | |
|---|---|---|---|
| KR | 10-2008-0105821 | A | 12/2008 |
| KR | 10-1163604 | B1 | 7/2012 |
| KR | 10-2014-0028885 | A | 3/2014 |

* cited by examiner

DISPLAY DRIVING DEVICE, DISPLAY DEVICE AND OPERATING METHOD THEREOF

CROSS-REFERENCE TO RELATED APPLICATION

This application claims priority from Korean Patent Application No. 10-2014-0156245, filed on Nov. 11, 2014, in the Korean Intellectual Property Office, the disclosure of which is incorporated herein in its entirety by reference.

BACKGROUND

The inventive concept relates to a display driving device, a display device, and an operating method of the display device, and more particularly, to a display driving device for improving the reliability of image-related data reception and reducing a chip size thereof, a display device, and an operating method of the display device.

In order to display high quality and wide view images, a display driving device for transmitting display data to a display panel needs to transmit display data at a high speed. In particular, the display data has to be transmitted at a high speed through a long transmission channel to drive a large display screen. However, due to a size limit of a printed circuit board (PCB), the PCB has to be separated into several substrates, and thus, an influence on a reflected wave increases at a connection part between the substrates, thereby causing transmission speed degradation. Accordingly, various methods are used to drive a large display screen, but have difficulties in overcoming technical limits.

SUMMARY

According to an aspect of the inventive concept, there is provided a display device including a display panel including a plurality of pixel arrangement areas, a data driving unit including a plurality of source drivers, each of which outputs display data to data lines of its corresponding pixels; and a timing controller configured to process data that is input from an external device and configured to generate output data. Each of the plurality of pixel arrangement areas includes a plurality of pixels arranged in areas in which a plurality of gate lines intersect a plurality of data lines. Each of the plurality of source drivers outputs display data to data lines of its corresponding pixels. The timing controller classifies the plurality of pixel arrangement areas based on a distance between the timing controller and each of the plurality of pixel arrangement areas, and transmits the output data to the data driving unit at at least two transmission speeds based on the classification.

The number of pixels of each of the plurality of pixel arrangement areas may change according to the distance between the timing controller and each of the plurality of pixel arrangement areas.

The display device may further include at least two transmission channels transmitting the output data from the timing controller to the data driving unit. At least one of at least two transmission channels transmits the output data at a speed other than speeds at which the other transmission channels transmit the output data.

The timing controller may include at least two port output terminals transmitting the output data to the data driving unit at different transmission speeds.

The plurality of pixel arrangement areas may include a first pixel arrangement area and a second pixel arrangement area. A vertical or horizontal distance from the timing controller to the first pixel arrangement area is shorter than that from the timing controller to the second pixel arrangement area.

The data driving unit may include a first source driver unit including at least one source driver for outputting a first display data group corresponding to the first pixel arrangement area, and a second source driver unit including at least one source driver for outputting a second display data group corresponding to the second pixel arrangement area. The first source driver unit and the second source driver unit are connected to the timing controller through a plurality of transmission channels.

A first transmission speed at which the timing controller transmits a first output data group to the first source driver unit may be higher than a second transmission speed at which the timing controller transmits a second output data group to the second source driver unit.

The number of pixels of the first pixel arrangement area may be greater than that of the second pixel arrangement area, and the amount of data of the first output data group may be greater than that of the second output data group.

The data driving unit may include an output data buffer unit for receiving the output data from the timing controller. The timing controller may control timing so that the first output data group and the second output data group are simultaneously received by the output data buffer unit.

The timing controller may include a first port output terminal that transmits the first output data group at the first transmission speed, and a second port output terminal that transmits the second output data group at the second transmission speed.

The number of electrical interconnection lines through which the first port output terminal is connected to the first source driver unit may be less than the number of electrical interconnection lines through which the second port output terminal is connected to the second source driver unit.

According to an aspect of the inventive concept, there is provided a display driving device including a display panel including first and second pixel arrangement areas, a data driving unit including a first source driver unit outputting a first display data group to a data line of the first pixel arrangement area and a second source driver unit outputting a second display data group to a data line of the second pixel arrangement area, and a timing controller configured to array data that is input from an external device and configured to transmit output data to the data driving unit at at least two transmission speeds. Each of the first and second pixel arrangement areas includes a plurality of pixels arranged in areas in which a plurality of gate lines intersect a plurality of data lines.

A printed circuit board (PCB) with the first source driver unit formed thereon may be connected to a PCB with the second source driver unit formed thereon through a bridge cable.

A vertical or horizontal distance from the timing controller to the first source driver unit may be shorter than that from the timing controller to the second source driver unit.

The amount of data of the first display data group may be greater than that of the second display data group.

The first source driver unit may include at least one first source driver supporting a first transmission speed. The second source driver unit may include at least one second source driver supporting a second transmission speed. The first transmission speed may be higher than the second transmission speed.

Each of at least one first source driver and at least one second source driver may include data line driving units. Each of the data line driving units is connected to a data line of one of pixels of the display panel, and provides output data. The number of data line driving units of the first source driver is greater than the number of data line driving units of the second source driver.

The number of pixels of the first pixel arrangement area may be greater than that of the second pixel arrangement area.

According to an aspect of the inventive concept, there is provided a display driving device including a display panel including first and second pixel arrangement areas, a data driving unit including a first source driver unit outputting a first display data group to data lines of the first pixel arrangement area and a second source driver unit outputting a second display data group to data lines of the second pixel arrangement area, and a timing controller configured to array data that is input from an external device. The timing controller transmits a first output data group to the first source driver unit at a first transmission speed, and transmits a second output data group to the second source driver unit at a second transmission speed. The first transmission speed is higher than the second transmission speed. Each of the first and second pixel arrangement areas includes a plurality of pixels arranged in areas in which a plurality of gate lines intersect a plurality of data lines.

The first source driver unit may include a first output data buffer unit that receives the first output data group. The second source driver unit may include a second output data buffer unit that receives the second output data group. The amount of data of the first output data group may be greater than that of the second output data group. The timing controller may control reception timing so that a time period at which the first output data buffer unit receives the first output data group is the same as a time period at which the second output data buffer unit receives the second output data group.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE EXEMPLARY EMBODIMENTS

Figure 1:
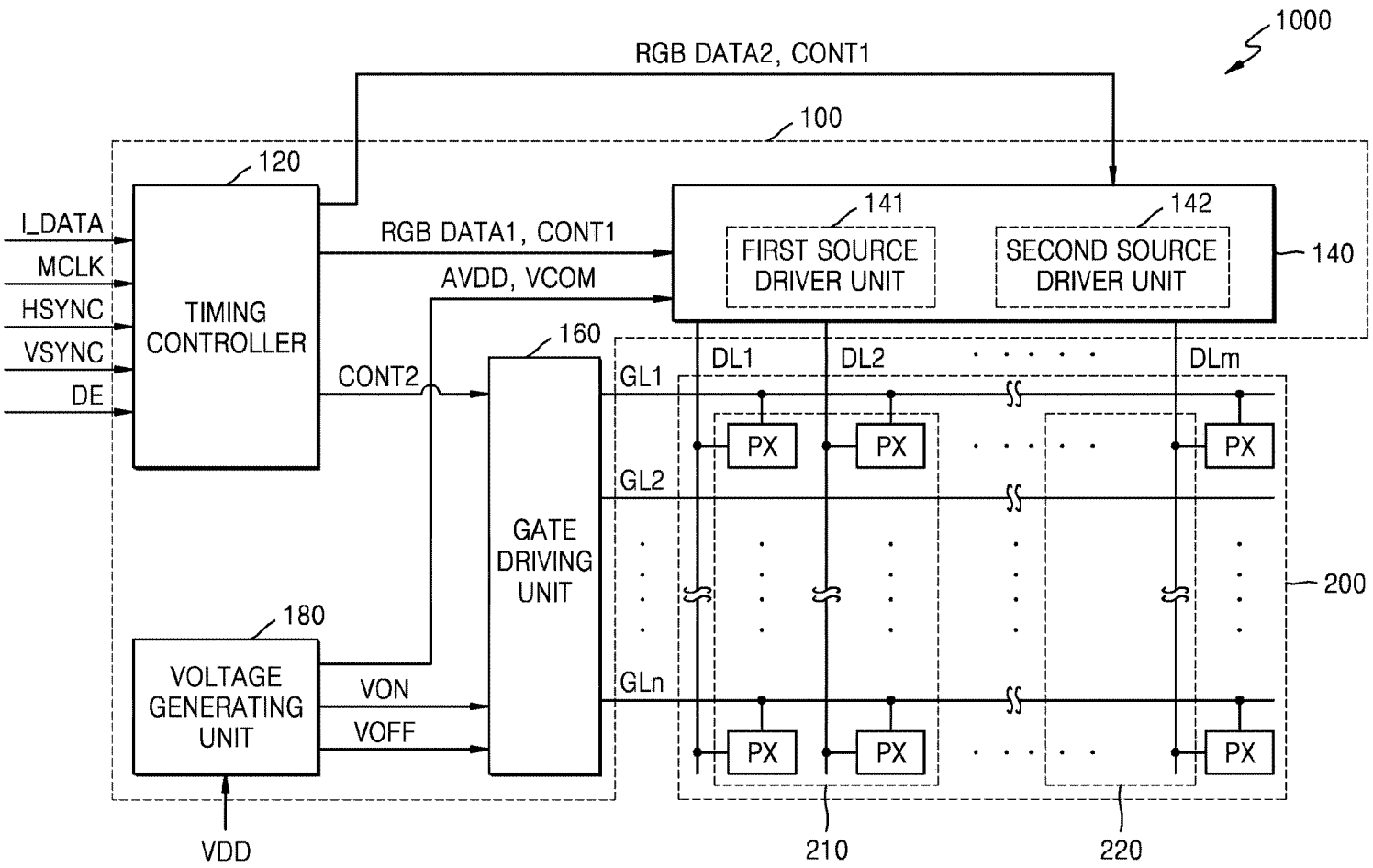
FIG. 1 is a block diagram of a display device according to an exemplary embodiment.

Reference will now be made in detail to exemplary embodiments of the inventive concept, examples of which are illustrated in the accompanying drawings. The exemplary embodiments are merely provided to fully describe the present inventive concept to one of ordinary skill in the art to which the present inventive concept pertains. As the present inventive concept allows for various changes and numerous exemplary embodiments, particular exemplary embodiments will be illustrated in the drawings and described in detail in the written description. However, this is not intended to limit the present inventive concept to particular modes of practice, and it will be understood that all changes, equivalents, and substitutes that do not depart from the spirit and technical scope of the present inventive concept are encompassed in the present inventive concept Like reference numerals refer to like elements throughout. Sizes of components in the drawings may be exaggerated for clarity. As used herein, the term "and/or" includes any and all combinations of one or more of the associated listed items. Expressions such as "at least one of," when preceding a list of elements, modify the entire list of elements and do not modify the individual elements of the list.

The terms used in the present specification are merely used to describe particular exemplary embodiments, and are not intended to limit the present inventive concept. An expression used in the singular encompasses the expression of the plural, unless it has a clearly different meaning in the context. In the present specification, it is to be understood that the terms such as "including", "having", and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

While such terms as "first," "second," etc., may be used to describe various components, such components must not be limited to the above terms. The above terms are used only to distinguish one component from another. For example, within the scope of the present inventive concept, a first component may be referred to as a second component, and vice versa.

Unless defined otherwise, all terms used in the description including technical or scientific terms have the same meaning as commonly understood by one of ordinary skill in the art to which the present inventive concept pertains. It will be further understood that terms, such as those defined in commonly used dictionaries, should be interpreted as having a meaning that is consistent with their meaning in the context of the related art, and should not be interpreted as having ideal or excessively formal meanings unless it is clearly defined in the specification.

FIG. 1 is a block diagram of a display device 1000 according to an exemplary embodiment.

Referring to FIG. 1, the display device 1000 may include a display driving device 100 and a display panel 200. The display driving device 100 may include a timing controller 120, a data driving unit 140 (e.g., a data driver, etc.), a gate driving unit 160 (e.g., a gate driver, etc.), and a voltage generating unit 180 (e.g., a voltage generator, etc.). Each of the data driving unit 140 and the gate driving unit 160 may include at least one source driver and at least one gate driver. Also, the data driving unit 140 may include a first source driver unit 141 (e.g., a first source driver, etc.) and a second source driver unit 142 (e.g., a second source driver, etc.). Each of the first source driver unit 141 and the second source driver unit 142 may include at least one source driver. Hereinafter, operations of the data driving unit 140 and the gate driving unit 160, and operations of at least one source driver and at least one gate driver may be interchangeably explained.

The timing controller 120 may generate various timing control signals or output data, for example, first output data RGB DATA1, second output data RGB DATA2, a first timing control signal CONT1, and a second timing control signal CONT2, for driving the data driving unit 140 and the gate driving unit 160. The first output data RGB DATA1 and the second output data RGB DATA2 that are transmitted by the timing controller 120 to the data driving unit 140 may have different transmission speeds. The timing controller 120 may receive external data I_DATA, a horizontal synchronization signal H_SYNC, a vertical synchronization signal V_SYNC, a clock signal MCLK, and a data enable signal DE from an external device (for example, a host device (not shown)).

The timing controller 120 may generate the first and second output data RGB DATA1 and RGB DATA2 by changing a format of the external data I_DATA in order to interface with the data driving unit 140, and may transmit the first and second output data RGB DATA1 and RGB DATA2 to the data driving unit 140. Also, the timing controller 120 may output at least one first timing control signal CONT1 to the data driving unit 140, and may output at least one second timing control signal CONT2 to the gate driving unit 160, based on the horizontal synchronization signal H_SYNC, the vertical synchronization signal V_SYNC, the clock signal MCLK, and the data enable signal DE, in order to control timings of a source driver and a gate driver.

The data driving unit 140 may receive the first timing control signal CONT1 or the first and second output data RGB DATA1 and RGB DATA2 from the timing controller 120, and may drive data lines DL1 through DLm of the display panel 200. The gate driving unit 160 may receive the second timing control signal CONT2 from the timing controller 120, and may drive gate lines GL1 through GLn of the display panel 200.

The voltage generating unit 180 may generate various voltages, for example, a gate-on voltage VON, a gate-off voltage VOFF, an analog power voltage AVDD, and a common voltage VCOM, which are necessary to drive the display panel 200. For example, the voltage generating unit 180 may receive a power voltage VDD from an external device, may generate the gate-on voltage VON and the gate-off voltage VOFF, and may apply the gate-on voltage VON and the gate-off voltage VOFF to the gate driving unit 160. The voltage generating unit 180 may generate the analog power voltage AVDD and the common voltage VCOM, and may apply the analog power voltage AVDD and the common voltage VCOM to the data driving unit 140.

The display device 1000 may be any of various flat panel display devices. Examples of the flat panel display device may include an LCD device, an organic electroluminescent (EL) display device, and a plasma display panel (PDP). Alternatively, the flat panel display device may be a flat panel display device that may sense a physical touch or an optical touch. The display device 1000 may be a hybrid flat panel display device. For convenience of explanation, the following will be explained on the assumption that the display device 1000 is the LCD device.

The display panel 200 may include the plurality of gate lines GL1 through GLn, the plurality of data lines DL1 through DLm that intersect the gate lines GL1 through GLn, and pixels PX that are arranged at intersections between the gate lines GL1 through GLn and the data lines DL1 through DLm. When the display device 1000 is a thin-film transistor (TFT) LCD device, each of the pixels PX may include a TFT that includes a gate electrode and a source electrode respectively connected to the gate lines GL1 through GLn and to the data lines DL1 through DLm. Each of the pixels PX may also include a liquid crystal capacitor (not shown) and a storage capacitor (not shown) that are connected to a drain electrode of the TFT.

In this structure, when a gate line is selected, a TFT of a pixel connected to the selected gate line is turned on. Then a data signal including pixel information is applied to each data line by the data driving unit 140. The data signal may be applied through the TFT of the pixel to a liquid crystal capacitor and a storage capacitor, and the liquid crystal and storage capacitor may be driven, thereby performing a display operation.

As the number of pixels PX of the display panel 200 that is driven by the display driving device 100 increases, the data driving unit 140 may include a plurality of source drivers, and each of the source drivers may drive a data line of a corresponding area of the display panel 200.

The display panel 200 may include a first pixel arrangement area 210, a second pixel arrangement area 220, and a third pixel arrangement area (not shown) according to locations where pixels PX of the display panel 200 are located. In an exemplary embodiment, the display panel 200 may be divided into groups, that is, the first pixel arrangement area 210, the second pixel arrangement area 220, and the third pixel arrangement area (not shown), based on a vertical or horizontal distance from each pixel arrangement area to the timing controller 120. For example, a vertical or horizontal distance from the timing controller 120 to the first pixel arrangement area 210 may be shorter than that from the timing controller 120 to the second pixel arrangement area 220. The vertical or horizontal distance from the timing controller 120 to the second pixel arrangement area 220 may be shorter than that from the timing controller 120 to the third pixel arrangement area (not shown). This will be described in detail with reference to FIG. 2. Hereinafter, the display device 1000 will be described on the assumption that the vertical or horizontal distance from the timing controller 120 to the first pixel arrangement area 210 is shorter than that from the timing controller 120 to the second pixel arrangement area 220. The number of pixels of the first pixel arrangement area 210, the number of pixels of the second pixel arrangement area 220, and the number of pixels of the third pixel arrangement area may be equal or different.

The data driving unit 140 may include the first source driver unit 141, the second source driver unit 142, and a third source driver unit (not shown) which include respectively at least one source driver for outputting display data to the display panel 200. The first source driver unit 141, the second source driver unit 142, and the third source driver unit (not shown) may include respectively the same type of source driver. For example, the first source driver unit 141 may include at least one source driver supporting a first transmission speed, and the second source driver unit 142 may include at least one source driver supporting a second transmission speed. Each source driver may include a plurality of data line driving units that are connected to a data line of a pixel of the display panel 200, and may output data. The number of data line driving units may be changed according to a transmission speed that may be supported by each source driver. The first source driver unit 141, the second source driver unit 142, and the third source driver unit (not shown) may be integrated into a single source driver chip.

The first source driver unit 141 may output display data to pixels of the first pixel arrangement area 210, and the second source driver unit 142 may output display data to pixels of the second pixel arrangement area 220. However, this is only an example, and an n-th source driver unit (not shown) may output display data to pixels of an n-th pixel arrangement area (not shown) (where n is a natural number that is equal to or greater than three.)

The numbers of pixels of the first to n-th pixel arrangement areas may differ, and for example, the number of pixels of the first pixel arrangement area 210 may be greater than that of the second pixel arrangement area 220. The size of the first pixel arrangement area 210 may be larger than or equal to that of the second pixel arrangement area 220. However, the inventive concept is not limited thereto, and the number of pixels of the second pixel arrangement area 220 may be greater than that of the first pixel arrangement area 210.

When the number of pixels of the first pixel arrangement area 210 is greater than that of the second pixel arrangement area 220, the amount of output data that is output by the first source driver unit 141 to the first pixel arrangement area 210 may be greater than the amount of output data that is output by the second source driver unit 142 to the second pixel arrangement area 220. Furthermore, the number of source drivers of the first source driver unit 141 may be different from that of the second source driver unit 142. In an exemplary embodiment, the number of source drivers of the first source driver unit 141 may be less than that of the second source driver unit 142. In this case, the number of transmission channels connected to the source drivers of the first source driver unit 141 and the timing controller 120 may be greater than that connected to the source drivers of the second source driver unit 142 and the timing controller 120.

As described above, the timing controller 120 may transmit the first and second output data RGB DATA1 and RGB DATA2 to the data driving unit 140 at at least two transmission speeds. In an exemplary embodiment, the timing controller 120 may provide the first output data RGB DATA1 to the first source driver unit 141 at a first transmission speed, and may provide the second output data RGB DATA2 to the second source driver unit 142 at a second transmission speed. The first transmission speed may be different than the second transmission speed, and furthermore, the first transmission speed may be higher than the second transmission speed. The first output data RGB DATA1 may be a set of data that is provided to each of the source drivers of the first source driver unit 141, and the second output data RGB DATA2 may be a set of data that is provided to each of the source drivers of the second source driver unit 142. The amount of first output data RGB DATA1 may be different than the amount of second output data RGB DATA2. When the amount of display data that is output by the first source driver unit 141 is greater than the amount of display data that is output by the second source driver unit 142, the amount of first output data RGB DATA1 may be greater than the amount of second output data RGB DATA2.

As described above, the timing controller 120 may transmit the first and second output data RGB DATA1 and RGB DATA2 to the data driving unit 140 at at least two transmission speeds, and the data driving unit 140 may include source drivers outputting display data to each pixel arrangement area of the display panel 200, thereby improving the performance of the display device 1000.

Figure 2:
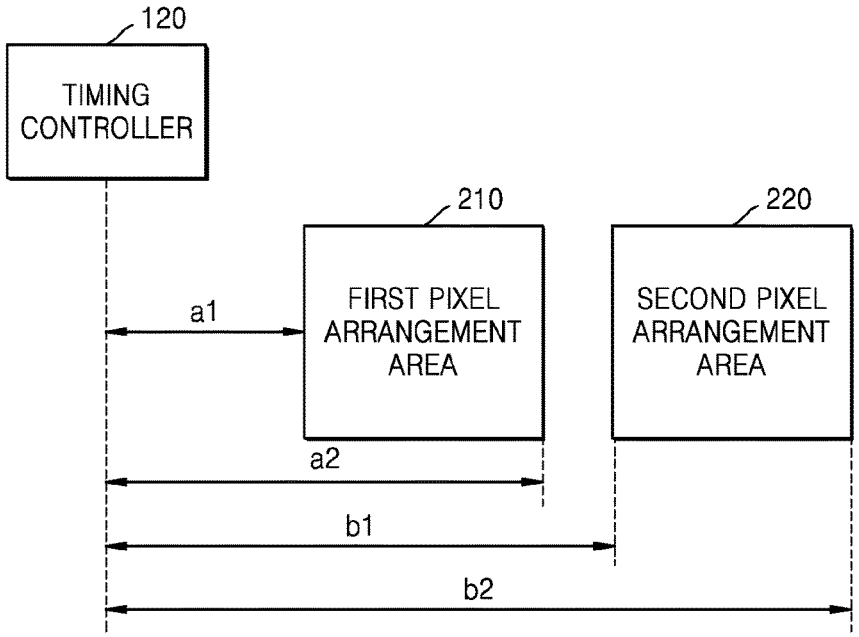
FIG. 2 is a diagram illustrating a criterion for dividing a display panel into a plurality of pixel arrangement areas, according to an exemplary embodiment.

FIG. 2 is a diagram illustrating a criterion for dividing a display panel into a plurality of pixel arrangement areas, according to an exemplary embodiment.

Referring to FIG. 2, the display panel may be divided into a first pixel arrangement area 210 and a second pixel arrangement area 220, according to locations where pixels of the display panel are located. Based on the timing controller 120, pixels placed between a horizontal distance a1 and a horizontal distance a2 may belong to the first pixel arrangement area 210, and pixels placed between a horizontal distance b1 and a horizontal distance b2 may belong to the second pixel arrangement area 220. However, this is only an example, and a1, a2, b1, and b2 may correspond to vertical distances based on the timing controller 120. Based on the timing controller 120, the first pixel arrangement area 210 may occupy a larger area than the second pixel arrangement area 220, and thus, the first pixel arrangement area 210 may include more pixels than the second pixel arrangement area 220. Accordingly, the amount of display data that is provided to the first pixel arrangement area 210 may be greater than the amount of display data that is provided to the second pixel arrangement area 220.

In FIG. 2, although the first pixel arrangement area 210 and the second pixel arrangement area 220 are separate from each other, the first pixel arrangement area 210 and the second pixel arrangement area 220 may correspond to areas that are adjacent and contiguous to each other. The display panel may include a plurality of pixel arrangement areas other than the first and second pixel arrangement areas 210 and 220, and the numbers of pixels of the pixel arrangement areas may differ.

In addition, referring to FIGS. 1 and 2, the display panel may be divided into the first pixel arrangement area 210 and the second pixel arrangement area 220 based on a vertical or horizontal distance from the timing controller 120 to each source driver unit of the data driving unit 140. For example, since a vertical or horizontal distance from the timing controller 120 to the first source driver unit 141 is shorter than that from the timing controller 120 to the second source driver unit 142, pixels PX to which the first source driver unit 141 provides display data may be classified as pixels of the first pixel arrangement area 210, and pixels PX to which the second source driver unit 142 provides display data may be classified as pixels of the second pixel arrangement area 220.

Figure 3:
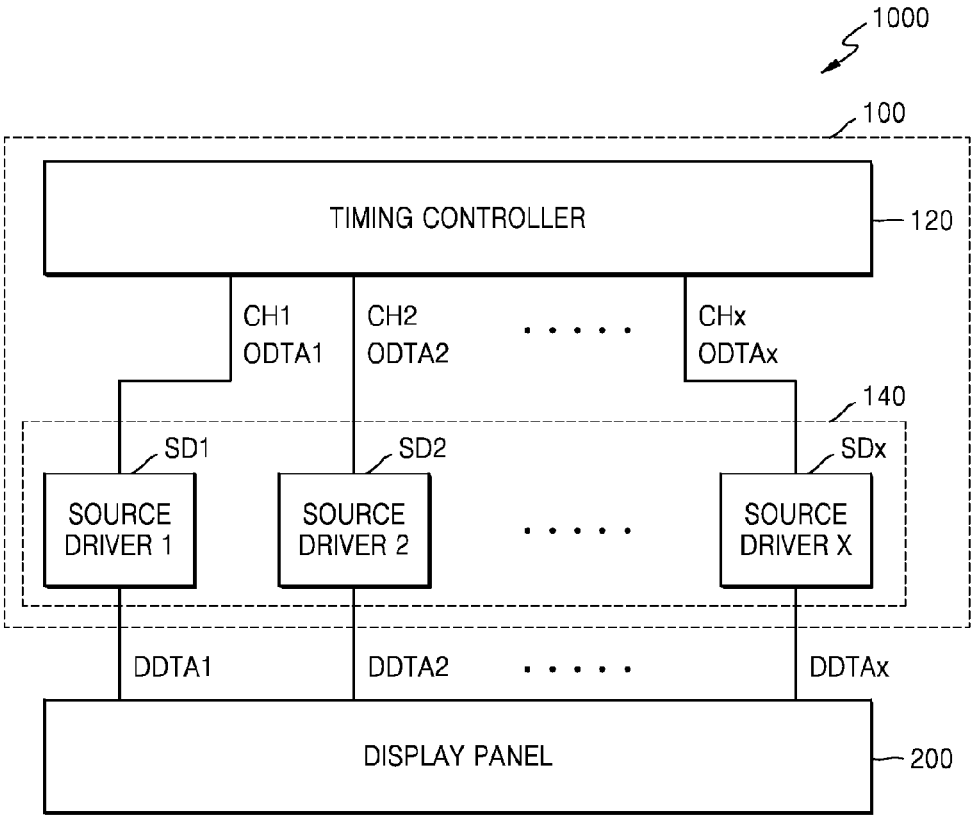
FIG. 3 is a block diagram of a display device according to an exemplary embodiment.

FIG. 3 is a block diagram of a display device 1000 according to an exemplary embodiment.

Referring to FIG. 3, a data driving unit 140 may include x (x is a positive integer equal to or greater than 2) source drivers, that is, first through xth source drivers SD1, SD2, . . . , and SDx. Each of the first through xth source drivers SD1, SD2, . . . , and SDx performs a function of the data driving unit 140. In detail, in order to transmit the display data DDTA to a display panel 200, the first through xth source drivers SD1, SD2, . . . , and SDx may respectively receive first through xth pieces of output data ODTA1, ODTA2, . . . , and ODTAx from a timing controller 120, may decode the received first through xth pieces of output data ODTA1, ODTA2, . . . , and ODTAx into analog voltages, may select one grayscale voltage among a plurality of grayscale voltages according to a result of the decoding, and may apply the selected grayscale voltage as first through xth pieces of display data DDTA1, DDTA2, . . . , and DDTAx to the display panel 200.

Each of the first through xth source drivers SD1, SD2, . . . , and SDx may be connected in a point-to-point manner to the timing controller 120. For example, the first source driver SD1 may be connected to the timing controller 120 through a first transmission channel CH1, and the second source driver SD2 may be connected to the timing controller 120 through a second transmission channel CH2. Likewise, the xth source driver SDx may be connected to the timing controller 120 through an xth transmission channel CHx. Although not shown in FIG. 4, some or all of the first and second timing control signals CONT1 and CONT2 of FIG. 1 may be provided separately from the first through xth transmission channels CH1, CH2, . . . , and CHx, and may be connected to the first through xth source drivers SD1, SD2, . . . , and SDx through channels that are connected to all of the first through xth source drivers SD1, SD2, . . . , and SDx.

The first through xth source drivers SD1, SD2, . . . , and SDx may respectively receive the first through xth pieces of output data ODTA1, ODTA2, . . . , and ODTAx that are applied through the first through xth transmission channels CH1, CH2, . . . , and CHx. For example, the first source driver SD1 may receive the first output data ODTA1 that is applied through the first transmission channel CH1, and the second source driver SD2 may receive the second output data ODTA2 that is applied through the second transmission channel CH2. Likewise, the xth source driver SDx may receive the xth output data ODTAx that is applied through the xth transmission channel CHx. As described above, the first through xth pieces of output data ODTA1, ODTA2, . . . , and ODTAx are data obtained after the timing controller 120 processes the input data IDTA.

Figure 4A:
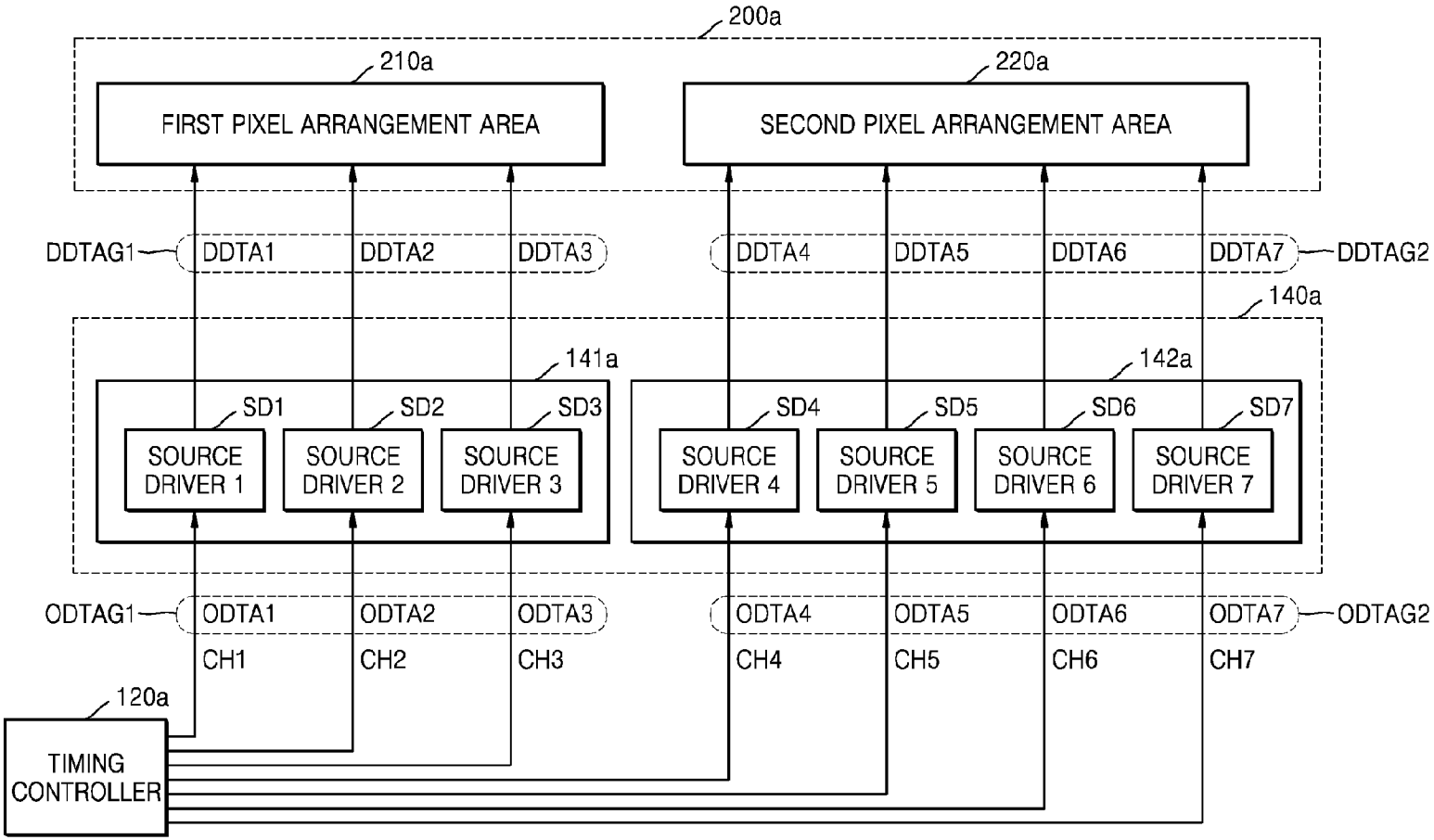
FIG. 4A is a diagram illustrating a data driving unit of the display device of FIG. 1, according to an exemplary embodiment.
Figure 4B:
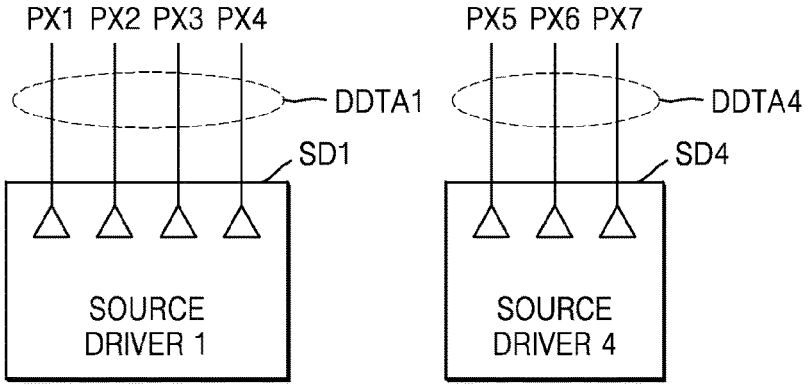
FIG. 4B is a diagram illustrating source drivers of the data driving unit of FIG. 1, according to an exemplary embodiment.

FIG. 4A is a diagram illustrating the data driving unit 140 of the display device 1000 of FIG. 1, according to an exemplary embodiment, and FIG. 4B is a diagram illustrating source drivers of the data driving unit 140, according to an exemplary embodiment.

A timing controller 120*a*, a data driving unit 140*a*, and a display panel 200*a*, which correspond to the timing controller 120, the data driving unit 140, and the display panel 200 in the display device 1000 of FIG. 3, are illustrated in FIG. 4A. The data driving unit 140*a* may include a first source driver unit 141*a* and a second source driver unit 142*a*. The first source driver unit 141*a* may include first through third source drivers SD1, SD2, and SD3, and the second source driver unit 142*a* may include fourth through seventh source drivers SD4, SD5, SD 6, and SD7. In an exemplary embodiment, the first source driver unit 141*a* may include at least one source driver supporting a first transmission speed, and the second source driver unit 142*a* may include at least one source driver supporting a second transmission speed.

The timing controller 120*a* may be connected to the first source driver unit 141*a* through transmission channels CH1 through CH3, and may be connected to the second source driver unit 142*a* through transmission channels CH4 through CH7. The first source driver unit 141*a* may output a first display data group DDTAG1 including first through third pieces of display data DDTA1, DDTA2, and DDTA3 to a first pixel arrangement area 210*a* that is closer to the timing controller 120*a* than a second pixel arrangement area 220*a*. The second source driver unit 142*a* may output a second display data group DDTAG2 including fourth through seventh pieces of display data DDTA4, DDTA5, DDTA6, and DDTA7 to the second pixel arrangement area 220*a*.

The timing controller 120*a* may transmit a first output data group ODTAG1 to the first source driver unit 141*a* at the first transmission speed, and may transmit a second output data group ODTAG2 to the second source driver unit 142*a* at the second transmission speed. In this case, the first transmission speed may be higher than the second transmission speed. Referring to FIG. 4B, the first source driver SD1 of the first source driver unit 141*a* may include four data line driving units, and may be connected to data lines of four pixels PX1 through PX4 and output the first display data DDTA1 to the data lines of the four pixels PX1 through PX4. The second and third source drivers SD2 and SD3 may have the same configuration as the first source driver SD1. The fourth source driver SD4 of the second source driver unit 142*a* may include three data line driving units, and may be connected to data lines of three pixels PX5 through PX7 and output the fourth display data DDTA4 to the data lines of the three pixels PX5 through PX7. The fifth through seventh source drivers SD5 through SD6 may have the same configuration as the fourth source driver SD4. However, this is only an example, and the number of data line driving units is not limited thereto and the first source driver SD1 may include more data line driving units than the fourth source driver SD4.

Accordingly, since the first source driver unit 141*a* includes source drivers that may simultaneously output more display data to data lines of more pixels than source drivers of the second source driver unit 142*a*, the first source driver unit 141*a* may support a higher transmission speed than the second source driver unit 142*a*. The amount of first output data ODTA1 that are transmitted to the first source driver SD1 may be greater than the amount of fourth output data ODTA4 that are transmitted to the fourth source driver SD4, and thus, the amount of display data DDTA1 that is output by the first source driver SD1 may be greater than the amount of display data DDTA4 that is output by the fourth source driver SD4.

That is, the source drivers of the first source driver unit 141*a* may receive more output data at a higher transmission speed and output more display data than the source drivers of the second source driver unit 142*a*. As a result, even if the number of source drivers of the first source driver unit 141*a* is less than that of the second source driver unit 142*a* as shown in FIG. 4A, the first source driver unit 141*a* may simultaneously receive the same amount of output data as the second source driver unit 142*a* or may simultaneously output the same amount of display data as the second source driver unit 142*a*. Each source driver is connected to the timing controller 120*a* through one or more electrical interconnection lines. Since the first source driver unit 141*a* includes the first through third source drivers SD1, SD2, and SD3 that may support the first transmission speed which is relatively high, the number of source drivers of the first source driver unit 141*a* may be reduced. Accordingly, the number of electrical interconnection lines that are connected to the first source driver unit 141*a* may be less than the number of electrical interconnection lines that are connected to the second source driver unit 142*a*, thereby reducing the production cost of the display device 1000. In addition, since the second output data group ODTAG2 is transmitted to the second source driver unit 142*a*, which outputs the second display data group DDTAG2 to the second pixel arrangement area 220*a* disposed in a position that is relatively distant from the timing controller 120*a*, at the second transmission speed that is lower than the first transmission speed, the display device 1000 may stably operate and the reliability of the display device 1000 may be improved.

Figure 5A:
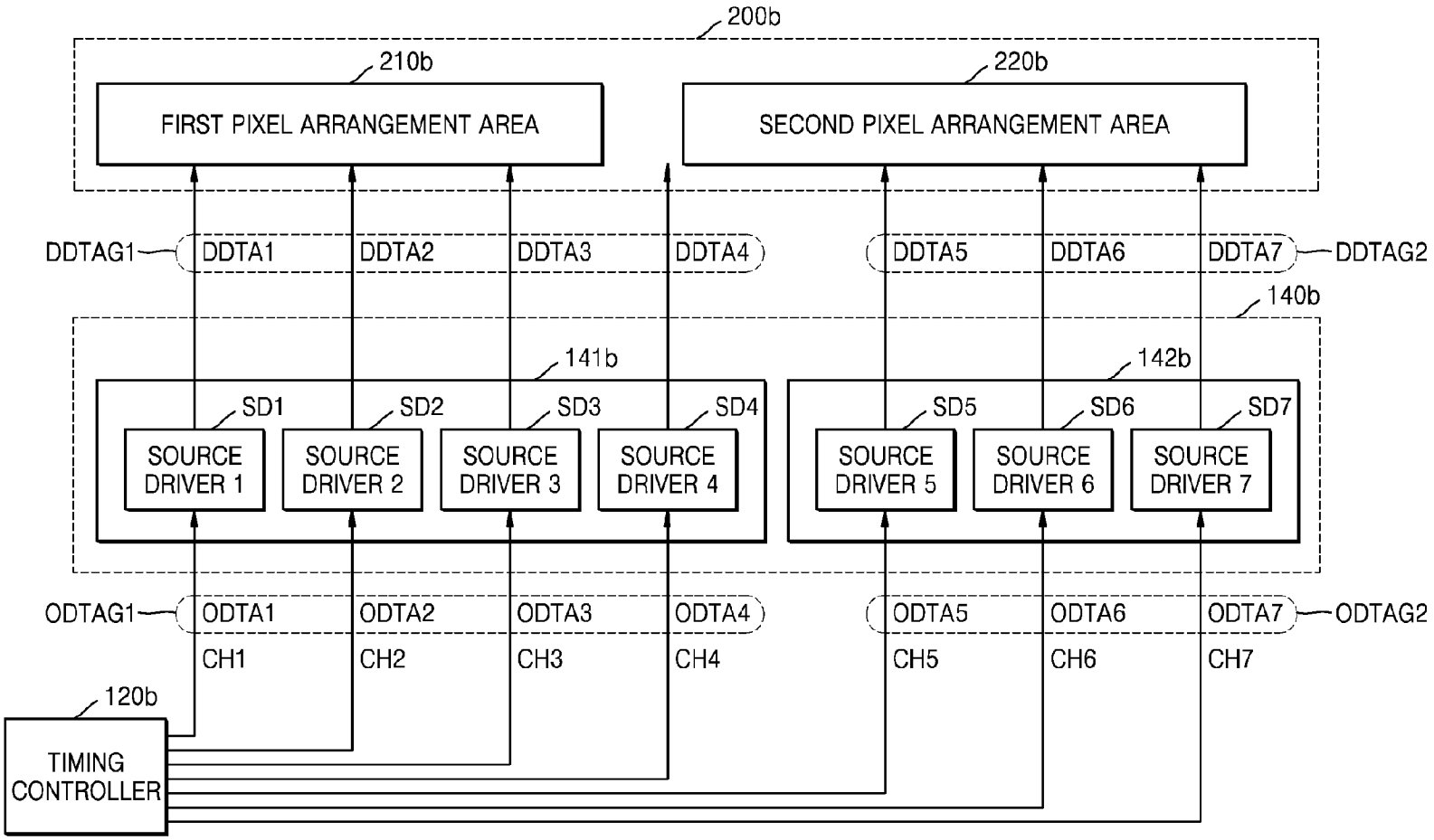
FIG. 5A is a diagram illustrating the data driving unit of FIG. 1, according to another exemplary embodiment.
Figure 5B:
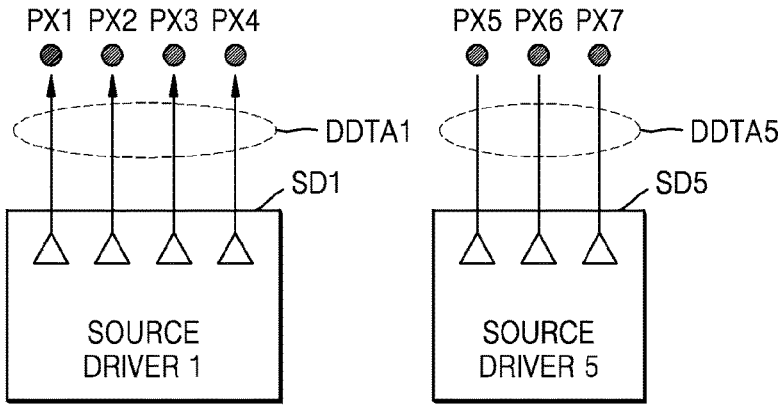
FIG. 5B is a diagram illustrating source drivers of the data driving unit of FIG. 1, according to another exemplary embodiment.

FIG. 5A is a diagram illustrating the data driving unit 140 of FIG. 1, according to another exemplary embodiment, and FIG. 5B is a diagram illustrating source drivers of the data driving unit 140, according to another exemplary embodiment.

Referring to FIG. 5A, unlike in FIG. 4A, the data driving unit 140*b* includes a first source driver unit 141*b* that may include first through fourth source drivers SD1, SD2, SD3, and SD4, and a second source driver unit 142*b* may include fifth through seventh source drivers SD5, SD6, and SD7.

A timing controller 120*b* may be connected to a first source driver unit 141*b* through transmission channels CH1 through CH4, and may be connected to a second source driver unit 142*b* through transmission channels CH5 through CH7. The first source driver unit 141*b* may output a first display data group DDTAG1 including first through third pieces of display data DDTA1, DDTA2, DDTA3, and DDTA4 to a first pixel arrangement area 210*b* that is closer to the timing controller 120*b* than a second pixel arrangement area 220*b*. The second source driver unit 142*b* may output a second display data group DDTAG2 including fifth through seventh pieces of display data DDTA5, DDTA6, and DDTA7 to the second pixel arrangement area 220*b*.

The timing controller 120*b* may provide a first output data group ODTAG1 to the first source driver unit 141*b* at a first transmission speed, and may provide a second output data group ODTAG2 to the second source driver unit 142*b* at a second transmission speed. In this case, the first transmission speed may be higher than the second transmission speed.

Referring to FIG. 5B, the first source driver SD1 of the first source driver unit 141*b* may include four data line driving units, and may be connected to data lines of four pixels PX1 through PX4 and output the first display data DDTA1 to the data lines of the four pixels PX1 through PX4. The second through fourth source drivers SD2 through SD4 may have the same configuration as the first source driver SD1. The fifth source driver SD5 of the second source driver unit 142*b* may include three data line driving units, and may be connected to data lines of three pixels PX5 through PX7 and output the fifth display data DDTA5 to the data lines of the three pixels PX5 through PX7. The sixth and seventh source drivers SD6 and SD7 may have the same configuration as the fifth source driver SD5. However, this is only an example, and the number of data line driving units is not limited thereto and the first source driver SD1 may include more data line driving units than the fifth source driver SD5.

Accordingly, since the first source driver unit 141*b* includes source drivers that may simultaneously output more display data to data lines of more pixels than source drivers of the second source driver unit 142*b*, the first source driver unit 141*b* may support a higher transmission speed than the second source driver unit 142*b*. The amount of first output data ODTA1 that are transmitted to the first source driver SD1 may be greater than the amount of fifth output data ODTA5 that are transmitted to the fifth source driver SD5, and thus, the amount of display data DDTA1 that is output by the first source driver SD1 may be greater than the amount of display data DDTA5 that is output by the fifth source driver SD5.

Furthermore, the amount of data of the first display data group DDTAG1 may be greater than that of the second display data group DDTAG2, and the first pixel arrangement area 210*b* may include more pixels than the second pixel arrangement area 220*b*. Accordingly, the area of the first pixel arrangement area 210*b* may be larger than that of the second pixel arrangement area 220*b*. However, this case is an example, and the timing controller 120*b* may transmit the first and second output data groups ODTAG1 and ODTAG2 at various transmission speeds, and each of the first and second source driver units 141*b* and 142*b* may include various source drivers supporting various transmission speeds.

Figure 6:
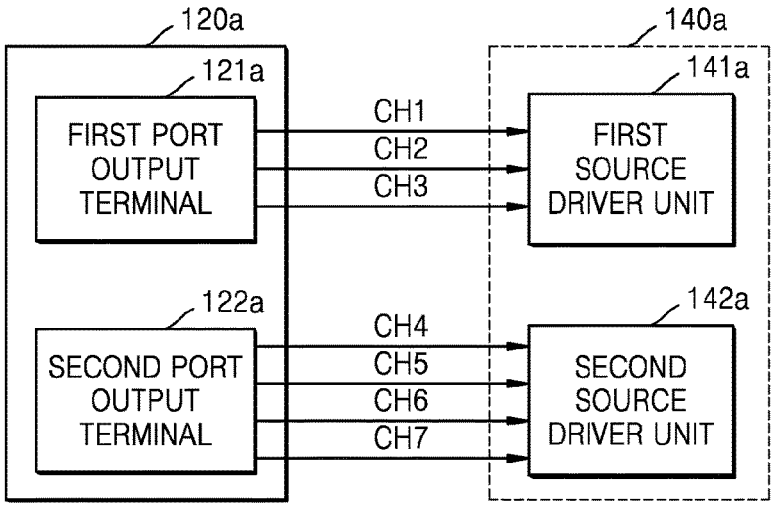
FIG. 6 is a diagram illustrating a timing controller of FIG. 4A, according to an exemplary embodiment.

FIG. 6 is a diagram illustrating the timing controller 120*a* of FIG. 4A, according to an exemplary embodiment.

Referring to FIG. 6, the timing controller 120*a* may include a first port output terminal 121*a* and a second port output terminal 122*a*. The first port output terminal 121*a* may provide to the first source driver unit 141*a* the first output data group ODTAG1, which is a set of output data that is transmitted to source drivers of the first source driver unit 141*a*, at the first transmission speed. The first output data group ODTAG1 may be transmitted through first through third transmission channels CH1 through CH3 at the first transmission speed. The second port output terminal 122*a* may provide to the second source driver unit 142*a* the second output data group ODTAG2, which is a set of output data that is transmitted to source drivers of the second source driver unit 142*a*, at the second transmission speed. The second output data group ODTAG2 may be transmitted via fourth through seventh transmission channels CH4 through CH7 at the second transmission speed. The first transmission speed may be higher than the second transmission speed. However, this case is an example, and the timing controller 120*a* may include various port output terminals and transmit the first and second output data groups ODTAG1 and ODTAG2 at various transmission speeds.

Figure 7A:
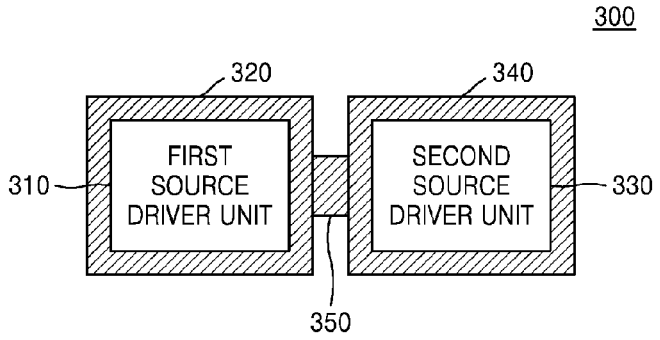
FIGS. 7A to 7C are diagrams illustrating exemplary embodiments in which a first source driver unit and a second source driver unit are formed on a printed circuit board (PCB)
Figure 7B:
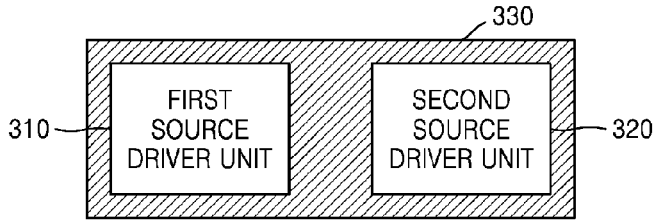
Figure 7C:
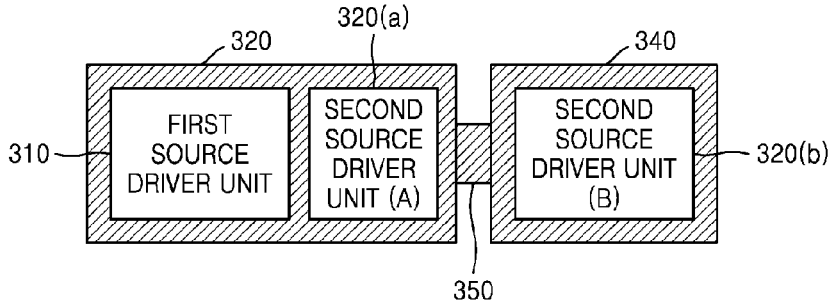

FIGS. 7A to 7C are diagrams illustrating exemplary embodiments in which a first source driver unit and a second source driver unit are formed on a printed circuit board (PCB).

Referring to FIG. 7A, a timing controller (not shown) may be positioned at the left side of a first source driver unit 310, a first source driver unit 310 may be formed on a first PCB 320, and a second source driver unit 330 may be formed on a second PCB 340. The first PCB 320 and the second PCB 340 may be connected to each other by a bridge cable 350.

In an exemplary embodiment, a signal such as output data that is provided to the second source driver unit 330 may pass through the bridge cable 350. Accordingly, based on the position of the bridge cable 350, the first source driver unit 310 having a first transmission speed that is a high transmission speed may be formed on the first PCB 320, and the second source driver unit 330 supporting a second transmission speed that is lower than the first transmission speed may be formed on the second PCB 340. The timing controller (not shown) may transmit output data to the first source driver unit 310 at the first transmission speed, and may transmit output data to the second source driver unit 330 at the second transmission speed.

Referring to FIG. 7B, a first source driver 310 and a second source driver unit 320 may be formed on the same PCB 330. Referring to FIG. 7C, a first source driver unit 310 and a portion 320*a* of a second source driver unit may be formed on a first PCB 320, and the other portion 320*b* of the second source driver unit may be formed on a second PCB 340. The first PCB 320 and the second PCB 340 may be connected to each other by a bridge cable 350.

Figure 8A:
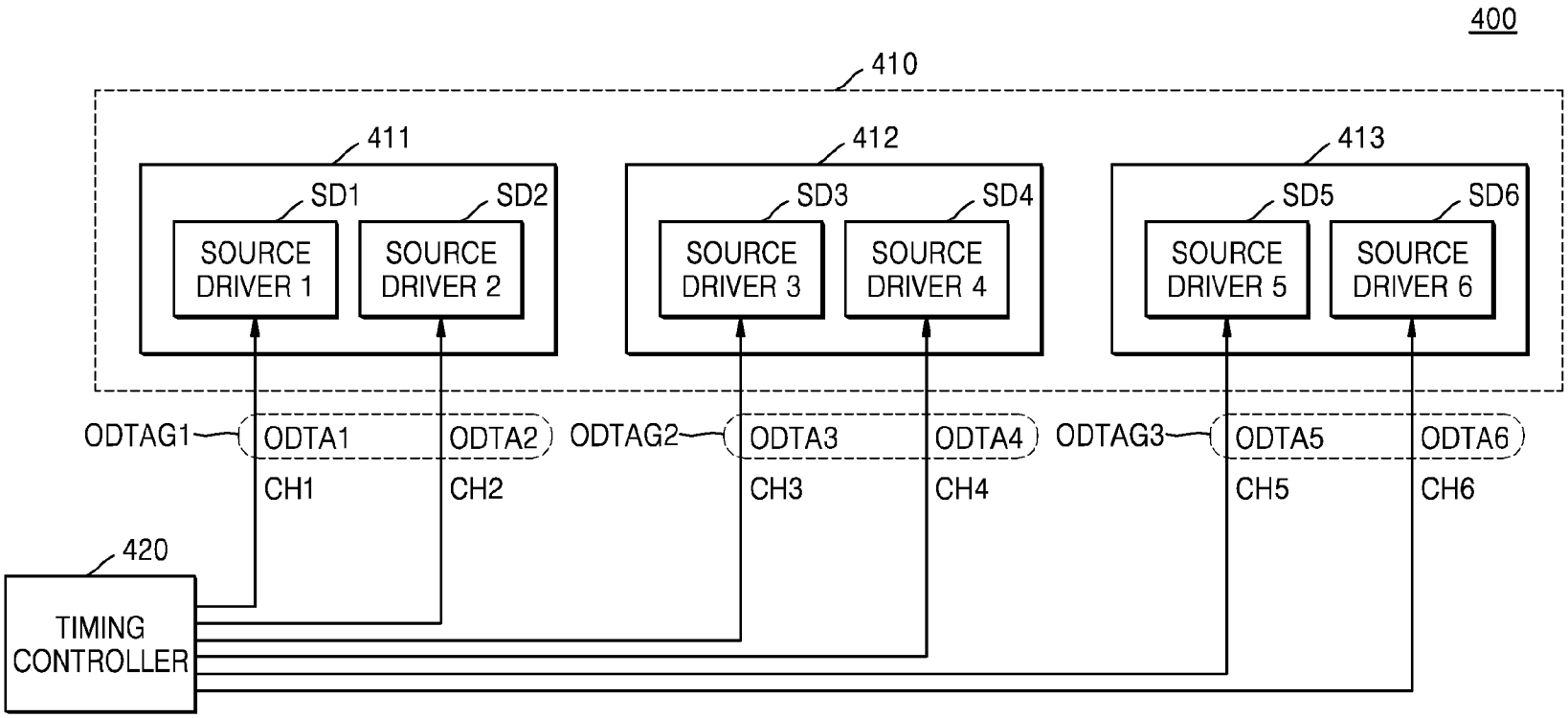
FIG. 8A is a diagram illustrating a display driving device according to an exemplary embodiment.
Figure 8B:
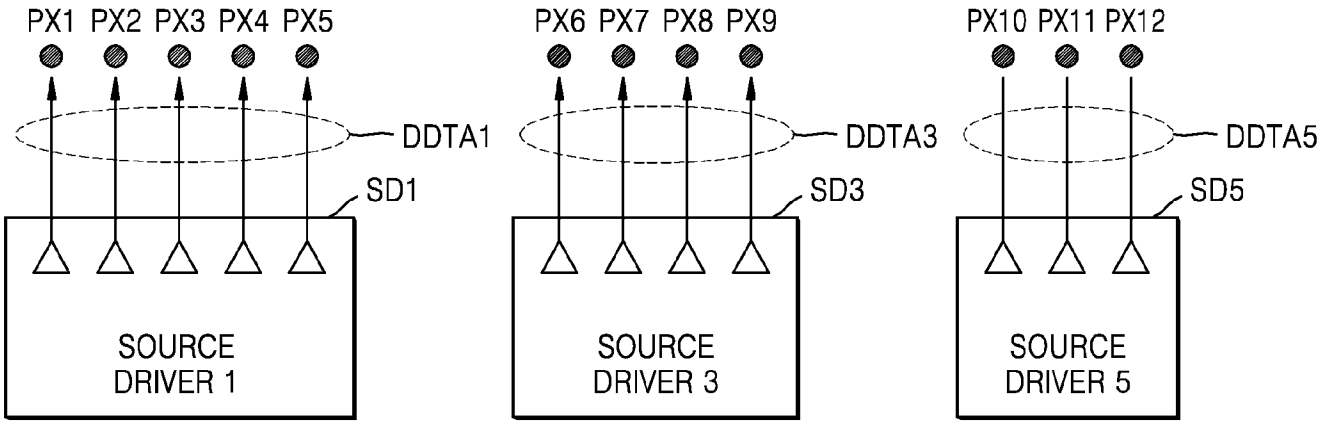
FIG. 8B is a diagram illustrating source drivers of the display driving device of FIG. 8A, according to an exemplary embodiment.

FIG. 8A is a diagram illustrating a display driving device according to an exemplary embodiment, and FIG. 8B is a diagram illustrating source drivers of the display driving device, according to an exemplary embodiment.

Referring to FIG. 8A, a data driving unit 410 may include a first source driver unit 411, a second source driver unit 412, and a third source driver unit 413. The first source driver unit 411 may include two source drivers, that is, first and second source drivers SD1 and SD2, the second source driver unit 412 may include two source drivers, that is, third and fourth source drivers SD3 and SD4, and the third source driver unit 413 may include two source drivers, that is, fifth and sixth source drivers SD5 and SD6. A timing controller 420 may be connected to the first source driver unit 411 through first and second transmission channels CH1 and CH2, may be connected to the second source driver unit 412 through third and fourth transmission channels CH3 and CH4, and may be connected to the third source driver unit 413 through fifth and sixth transmission channels CH5 and CH6.

Referring to FIG. 8B, the first source driver SD1 of the first source driver unit 411 may include five data line driving units, and may be connected to data lines of five pixels PX1 through PX5 and output first display data DDTA1 to the data lines of the five pixels PX1 through PX5. The second source driver SD2 may have the same configuration as the first source driver SD1. The third source driver SD3 of the second source driver unit 412 may include four data line driving units, and may be connected to data lines of four pixels PX6 through PX9 and output third display data DDTA3 to the data lines of the four pixels PX6 through PX9. The fourth source driver SD4 may have the same configuration as the third source driver SD3. The fifth source driver SD5 of the third source driver unit 413 may include three data line driving units, and may be connected to data lines of three pixels PX10 through PX12 and output fifth display data DDTA5 to the data lines of the three pixels PX10 through PX12. However, this is only an example, and the number of data line driving units is not limited thereto and the number of data line driving units of each source driver may be changed.

Accordingly, the timing controller 420 may provide a plurality of pieces of output data at various transmission speeds. For example, the timing controller 420 may provide a first output data group ODTAG1 to the first source driver unit 411 at a first transmission speed, may provide a second output data group ODTAG2 to the second source driver unit 412 at a second transmission speed, and may provide a third output data group ODTAG3 to the third source driver unit 413 at a third transmission speed. In this case, the first transmission speed may be higher than the second transmission speed, and the second transmission speed may be higher than the third transmission speed. In addition, the first and second source drivers SD1 and SD2 of the first source driver unit 411 may support a transmission speed that is higher than that of the third and fourth source drivers SD3 and SD4 of the second source driver unit 412, and the third and fourth source drivers SD3 and SD4 of the second source driver unit 412 may support a transmission speed that is higher than that of the fifth and sixth source drivers SD5 and SD6 of the third source driver unit 413. However, this is only an example, and the inventive concept is not limited thereto.

Figure 9:
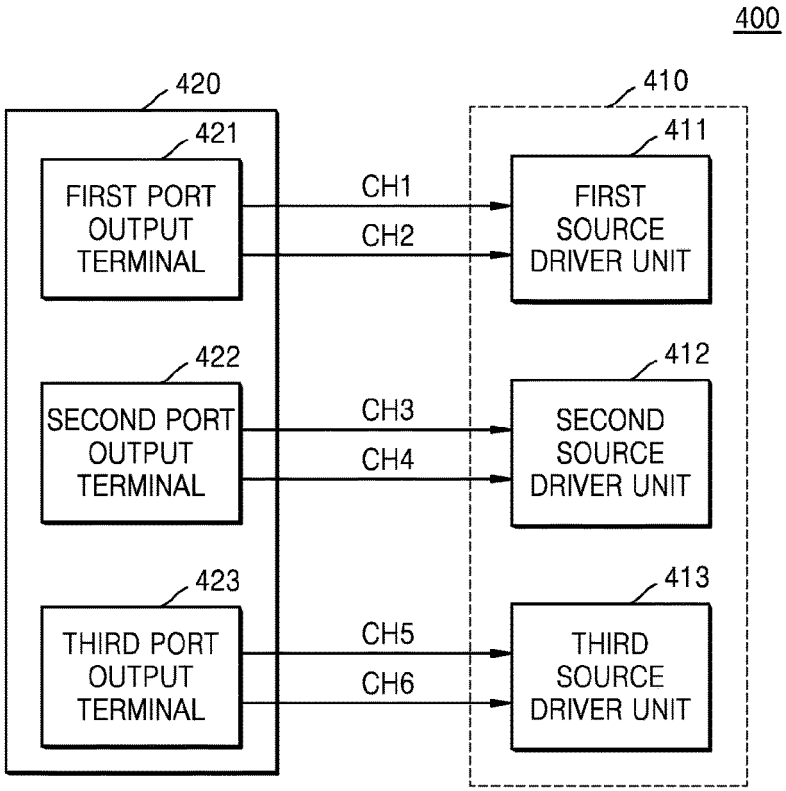
FIG. 9 is a diagram illustrating a timing controller of FIG. 8A, according to an exemplary embodiment.

FIG. 9 is a diagram 400 illustrating the timing controller 420 of FIG. 8A, according to an exemplary embodiment.

Referring to FIG. 9, the timing controller 420 may include a first port output terminal 421, a second port output terminal 422, and a third port output terminal 423. The first port output terminal 421 may provide output data to a first source driver unit 411 at a first transmission speed. The first port output terminal 421 may transmit output data through first and second transmission channels CH1 and CH2 at the first transmission speed. The second port output terminal 422 may provide output data to a second source driver unit 412 at a second transmission speed. The second port output terminal 422 may transmit output data through third and fourth transmission channels CH3 and CH4 at the second transmission speed. The third port output terminal 423 may provide output data to a third source driver unit 413 at a third transmission speed. The third port output terminal 423 may transmit output data through fifth and sixth transmission channels CH5 and CH6 at the third transmission speed. The first transmission speed may be higher than the second transmission speed, and the second transmission speed may be higher than the third transmission speed. However, this case is an example, and the inventive concept is not limited thereto. For example, the first transmission speed may be equal to the second transmission speed, and the second transmission speed may be higher than the third transmission speed. Alternatively, the first transmission speed may be higher than the second transmission speed, and the second transmission speed may be equal to the third transmission speed. In another exemplary embodiment, the timing controller 420 may include various port output terminals and transmit output data at various transmission speeds.

Figure 10:
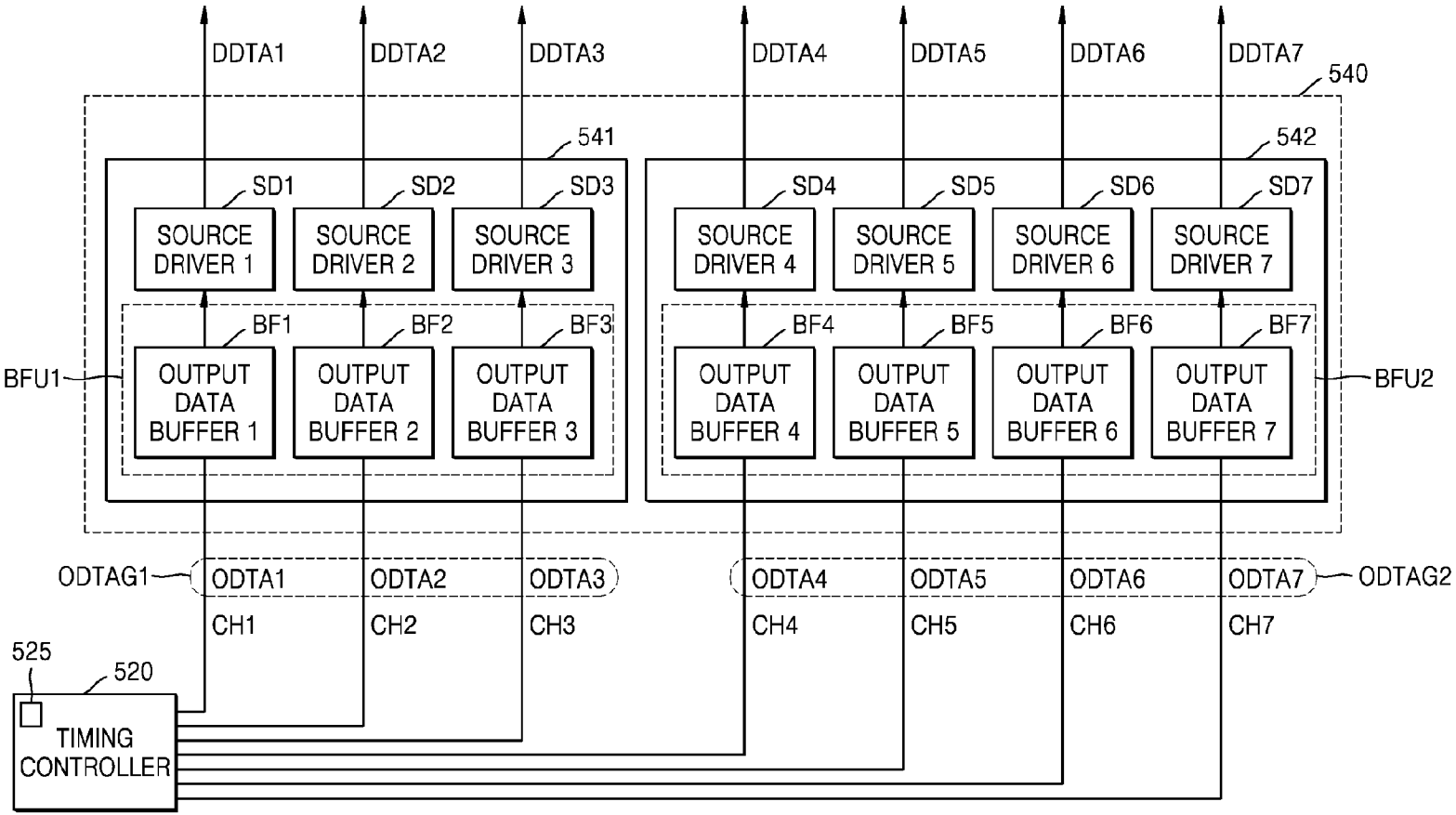
FIG. 10 is a diagram illustrating a display driving device according to another exemplary embodiment.

FIG. 10 is a diagram illustrating a display driving device 500 according to another exemplary embodiment.

Referring to FIG. 10, the display driving device 500 may include a data driving unit 540 and a timing controller 520. The data driving unit 540 may further include output data buffers BF1 through BF7 respectively connected to source drivers SD1 through SD7. However, this is only an example, and the data driving unit 540 may be configured that the output data buffers BF1 through BF7 are respectively included in the source drivers SD1 through SD7. Each of the output data buffers BF1 through BF7 may receive output data provided by the timing controller 520, and may store the received output data. The timing controller 520 may provide first through third pieces of output data ODTA1, ODTA2, and ODTA3 to first through third output data buffers BF1, BF2, and BF3 of a first source driver unit 541 via first through third transmission channels CH1, CH2, and CH3, respectively, at a first transmission speed. Also, the timing controller 520 may provide fourth through seventh pieces of output data ODTA4, ODTA5, ODTA6, and ODTA7 to fourth through seventh output data buffers BF4, BF5, BF6, and BF7 of a second source driver unit 542 via fourth through seventh transmission channels CH4, CH5, CH6, and CH7, respectively, at a second transmission speed. The first transmission speed may be higher than the second transmission speed. However, this is only an example, and the data driving unit 540 may include a plurality of source driver units, and each source driver unit may include various source drivers and output data buffers to have various configurations.

The amount of data of each of the first through third pieces of output data ODTA1, ODTA2, and ODTA3 that are provided to the first source driver unit 541 may be greater than that of each of the fourth through seventh pieces of output data ODTA4, ODTA5, ODTA6, and ODTA7 that are provided to the second source driver unit 542.

In order for the source drivers SD1 through SD3 of the first source driver unit 541 and the source drivers SD4 through SD7 of the second source driver unit 542 to simultaneously output first through seventh display data DDTA1 through DDTA7, the first through seventh pieces of output data ODTA1 through ODTA7 need to be completely stored in the first through seventh output data buffers BF1 through BF7, respectively. Accordingly, the timing controller 520 may control timing so that the first through seventh output data buffers BF1 through BF7 simultaneously receive the first through seventh pieces of output data ODTA1 through ODTA7, respectively. The first through third output data buffers BF1 through BF3 may be included in a first output data buffer unit BFU1, and the fourth through seventh output data buffers BF4 through BF7 may be included in a second output data buffer unit BFU1. The timing controller 520 may control reception timing so that a time period at which the first output data buffer unit BFU1 receives a first output data group ODTAG1 is the same as a time period at which the second output data buffer unit BFU2 receives a second output data group ODTAG2. The first output data group ODTAG1 may include first through third pieces of output data ODTA1, ODTA2, and ODTA3, and the second output data group ODTAG2 may include fourth through seventh pieces of output data ODTA4, ODTA5, ODTA6, and ODTA7.

The timing controller 525 may further include a reception timing control unit 525 for controlling the reception timing described above. The reception timing control unit 525 may receive a signal indicating whether each of the first through seventh output data buffers BF1 through BF7 has received output data, and may control the reception timing based on the signal.

Figure 11A:
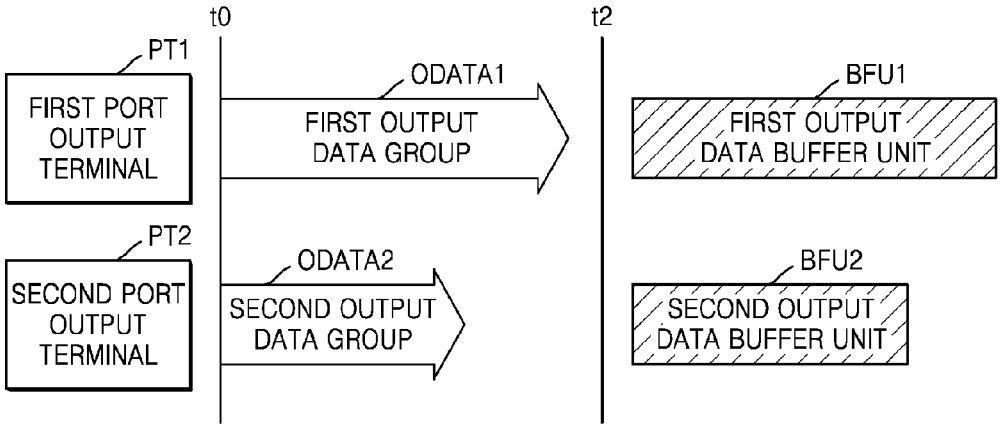
FIGS. 11A, 11B, and 11C are diagrams illustrating methods in which a timing controller of FIG. 10 controls reception timing in which a first output data buffer unit receives a first output data group and a second output data buffer unit receives a second output data group.
Figure 11B:
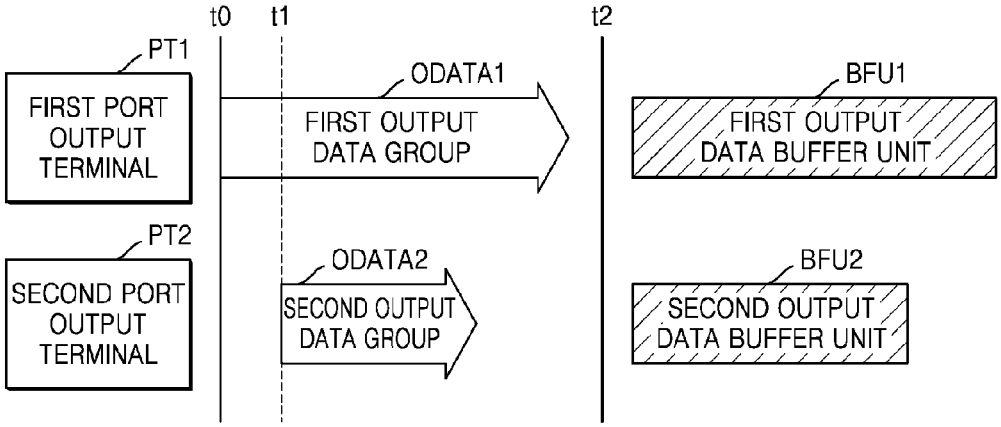
Figure 11C:
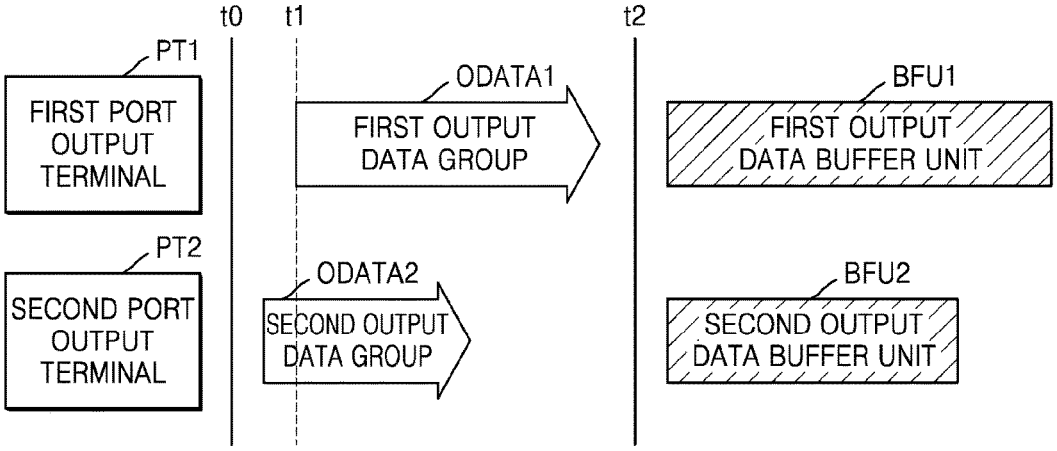

FIGS. 11A, 11B, and 11C are diagrams illustrating methods in which the timing controller 525 of FIG. 10 controls reception timing at which the first output data buffer unit BFU1 receives the first output data group ODTAG1 and the second output data buffer unit BFU2 receives the second output data group ODTAG2.

Referring to FIGS. 11A, 11B, and 11C, a first port output terminal PT1 may provide the first output data group ODTAG1 to the first output data buffer unit BFU1 at a first transmission speed, and a second port output terminal PT2 may provide the second output data group ODTAG2 to the second output data buffer unit BFU2 at a second transmission speed. In this case, the first transmission speed may be higher than the second transmission speed, and the amount of data of the first output data group ODTAG1 may be equal to or greater than that of the second output data group ODTAG2.

Referring to FIG. 11A, the reception timing control unit 525 may control the first port output terminal PT1 and the second port output terminal PT2 so that the first and second output data groups ODTAG1 and ODTAG2 are simultaneously transmitted at time t0 and the transmitted first and second output data groups ODTAG1 and ODTAG2 are simultaneously received at time t2 by the first and second output data buffer units BFU1 and BFU2, respectively.

Referring to FIG. 11B, the reception timing control unit 525 may control the first port output terminal PT1 and the second port output terminal PT2 so that the first output data group ODTAG1 is transmitted at time t0, the second output data group ODTAG2 is transmitted at time t1, and the transmitted first and second output data groups ODTAG1 and ODTAG2 are simultaneously received at time t2 by the first and second output data buffer units BFU1 and BFU2, respectively.

Referring to FIG. 11C, the reception timing control unit 525 may control the first port output terminal PT1 and the second port output terminal PT2 so that the second output data group ODTAG2 is transmitted at time t0, the first output data group ODTAG1 is transmitted at time t1, and the transmitted first and second output data groups ODTAG1 and ODTAG2 are simultaneously received at time t2 by the first and second output data buffer units BFU1 and BFU2, respectively. The control methods of the reception timing control unit 525, illustrated in FIGS. 11A, 11B, and 11C, may be selectively performed in consideration of a distance between the timing controller 525 and the first source driver unit 541 including the first output data buffer unit BFU1, and a distance between the timing controller 525 and the second source driver unit 542 including the second output data buffer unit BFU2.

Figure 12:
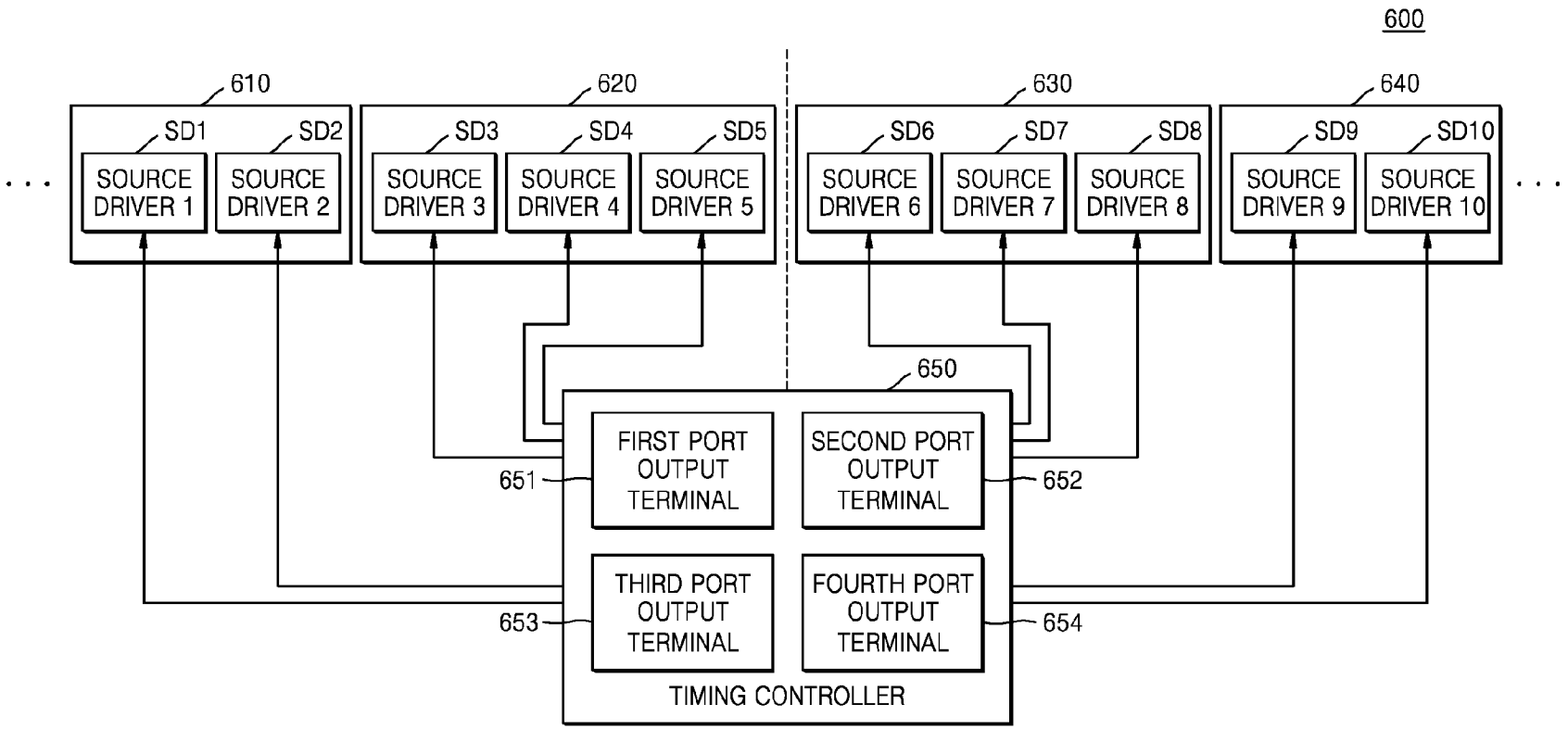
FIG. 12 is a diagram illustrating a display driving device according to another exemplary embodiment.

FIG. 12 is a diagram illustrating a display driving device 600 according to another exemplary embodiment.

Referring to FIG. 12, the display driving device 600 may include a first source driver unit 610 (e.g., a first source driver, etc.), a second source driver unit 620 (e.g., a second source driver, etc.), a third source driver unit 630 (e.g., a third source driver, etc.), a fourth source driver unit 640 (e.g., a fourth source driver, etc.), and a timing controller 650. The timing controller 650 may include a first port output terminal 651, a second port output terminal 652, a third port output terminal 653, and a fourth port output terminal 654. The timing controller 650 may control the first port output terminal 651 so that output data is transmitted from the first port terminal 651 to the second source driver unit 620 at a first transmission speed. The timing controller 650 may also control the second port output terminal 652 so that output data is transmitted from the second port terminal 652 to the third source driver unit 630 at a second transmission speed. Also, the timing controller 650 may control the third port output terminal 653 so that output data is transmitted from the third port terminal 653 to the first source driver unit 610 at a third transmission speed. Further, the timing controller 650 may control the fourth port output terminal 654 so that output data is transmitted from the fourth port terminal 654 to the fourth source driver unit 640 at a fourth transmission speed. The timing controller 650 may differently control an output data transmission speed according to a vertical or horizontal distance between each source driver unit and the timing controller 650. In an exemplary embodiment, the first transmission speed and the second transmission speed may be equal to each other since a vertical or horizontal distance between the second source driver unit 620 and the timing controller 650 is equal to that between the third source driver unit 630 and the timing controller 650. In addition, the third transmission speed and the fourth transmission speed may be equal to each other since a vertical or horizontal distance between the first source driver unit 610 and the timing controller 650 is equal to that between the fourth source driver unit 640 and the timing controller 650. However, since the vertical or horizontal distance between the first source driver unit 610 and the timing controller 650 is greater than that between the second source driver unit 620 and the timing controller 650, the timing controller 650 may be controlled so that the first transmission speed is higher than the third transmission speed. Likewise, since the vertical or horizontal distance between the fourth source driver unit 640 and the timing controller 650 is greater than that between the third source driver unit 630 and the timing controller 650, the timing controller 650 may be controlled so that the second transmission speed is higher than the fourth transmission speed.

Referring to FIG. 12, the second source driver unit 620 and the third source driver unit 630 may have the same configuration. That is, the second source driver unit 620 and the third source driver unit 630 may include the same type of source drivers (for example, source drivers supporting the same transmission speed) and the same number of source drivers, and dispositions on PCBs may be the same. In addition, the first source driver unit 610 and the fourth source driver unit 640 may have the same configuration, thereby providing a symmetrical structure centered on the timing controller 650. Furthermore, the display driving device 600 may include more source drivers and form a symmetrical structure.

Figure 13:
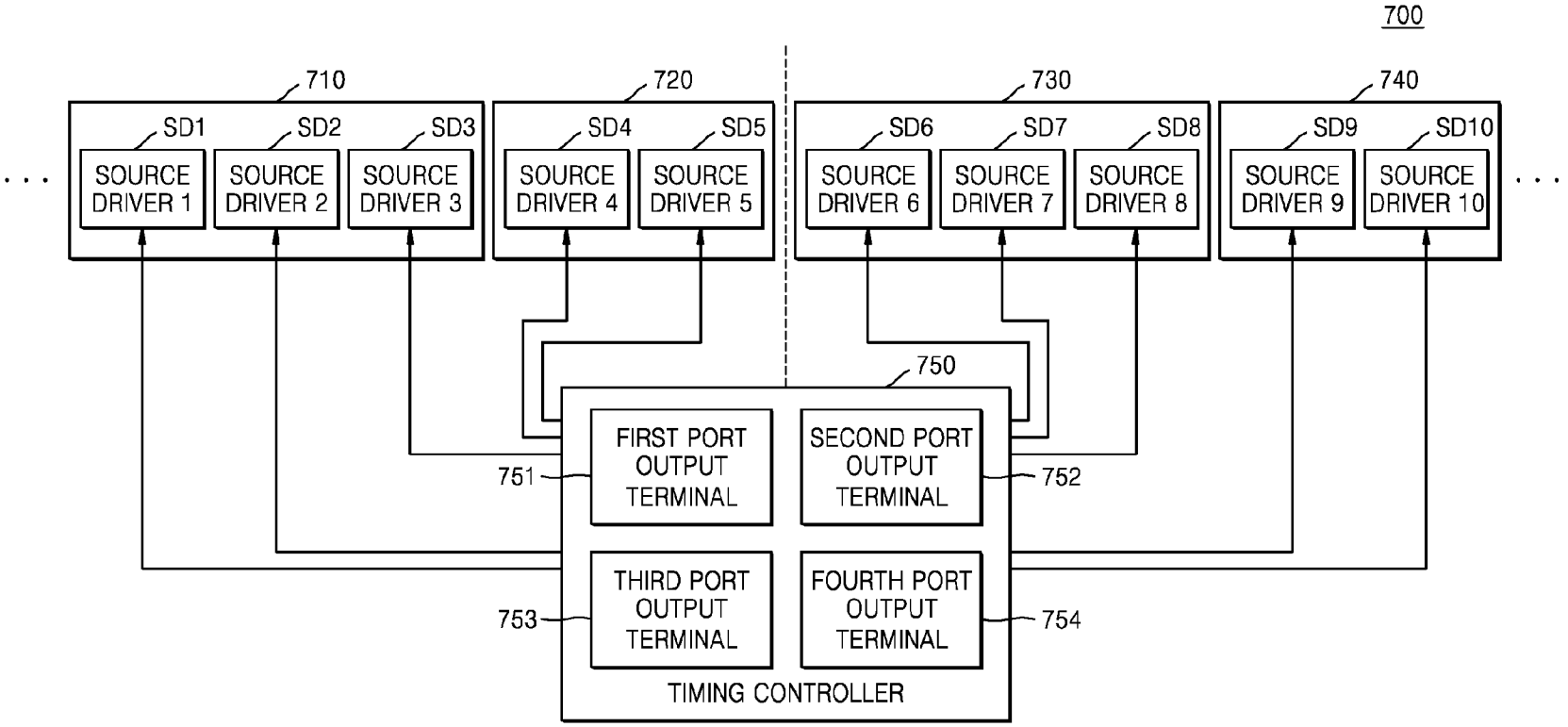
FIG. 13 is a diagram illustrating a display driving device according to another exemplary embodiment.

FIG. 13 is a diagram illustrating a display driving device 700 according to another exemplary embodiment.

Referring to FIG. 13, the display driving device 700 may have an asymmetrical structure centered on a timing controller 750, unlike the display driving device 600 of FIG. 12. That is, based on the number of source drivers, a second source driver unit 720 and a third source driver unit 730 may be different in configuration, and a first source driver unit 710 and a fourth source driver unit 740 may be different in configuration. Thus, the display driving device 700 may have an asymmetrical structure. However, the inventive concept is not limited thereto, and the display driving device 700 may have an asymmetrical structure due to various structural characteristics such as disposition positions of source drivers on a PCB.

Figure 14:
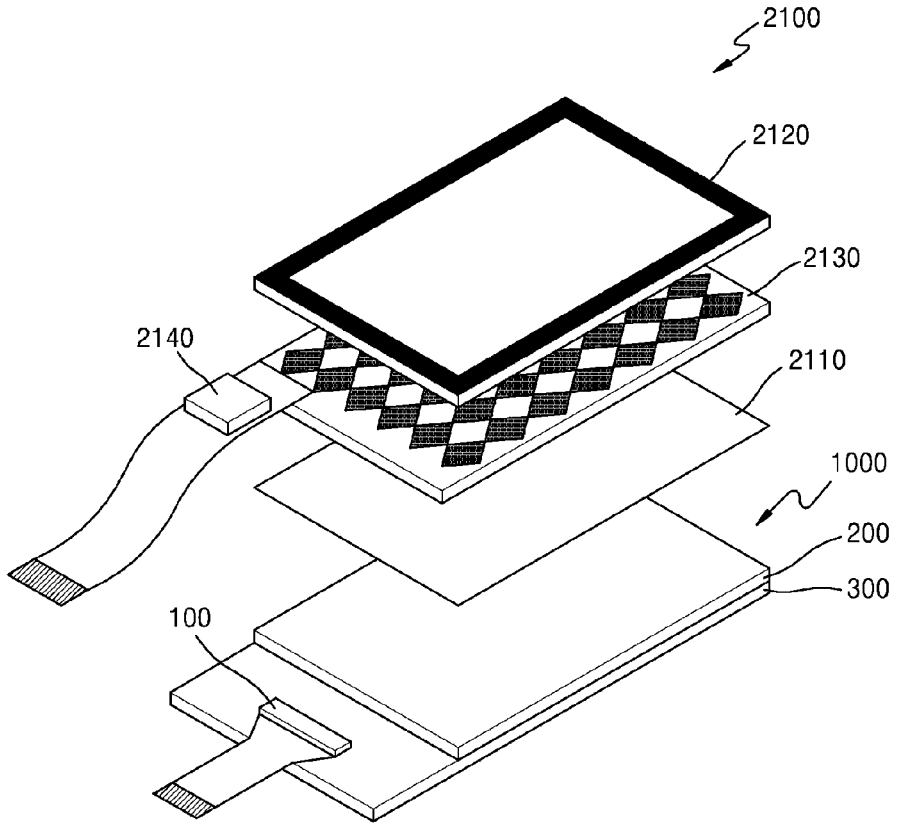
FIG. 14 is an exploded perspective view illustrating a display module according to an exemplary embodiment.

FIG. 14 is an exploded perspective view illustrating a display module 2100 according to an exemplary embodiment.

Referring to FIG. 14, the display module 2100 may include a display device 1000 of FIG. 1, a polarizing plate 2110, and a window glass 2120. The display device 1000 may include a display panel 200, a printed board 300, and a display driving device 100.

The window glass 2120 is generally formed of a material such as acryl or tempered glass, and the window glass 2120 may protect the display module 2100 from being scratched due to a repeated touch or an external impact. The polarizing plate 2110 may be provided to improve optical characteristics of the display panel 200. The display panel 200 may be patterned and formed as a transparent electrode on the printed board 2120. The display panel 200 may include a plurality of pixel cells for displaying a frame. The display panel 200 may be an organic light-emitting diode panel. Each of the pixel cells may include an organic light-emitting diode that emits light in response to the flow of current. However, the present exemplary embodiment is not limited thereto, and the display panel 200 may include any of diverse display elements. For example, the display panel 200 may be one of an LCD panel, an electrochromic display (ECD) panel, a digital mirror device (DMD), an actuated mirror device (AMD), a grating light valve (GLV), a plasma display panel (PDP), an electro luminescent display (ELD) panel, a light-emitting diode (LED) display panel, and a vacuum fluorescent display (VFD) panel.

The display driving device 100 may be the display driving device 100 of FIG. 1. Although the display driving device 100 in FIG. 14 is one chip for convenience of explanation, the present exemplary embodiment is not limited thereto, and the display driving device 100 may be mounted as a plurality of chips. Also, the display driving device 100 may be mounted as a chip-on-glass (COG) type on the printed board 300 formed of glass material. However, the present exemplary embodiment is not limited thereto, and the display driving device 100 may be mounted as any of various types such as a chip-on-film (COF) type or a chip-on-board (COB) type.

The display module 2100 may further include a touch panel 2130 and a touch controller 2140. The touch panel 2130 may be formed by patterning a transparent electrode such as an electrode formed of indium tin oxide (ITO) on a glass substrate or a polyethylene terephthalate (PET) film. The touch controller 2140 may detect a touch on the touch panel 2130, may calculate coordinates of the touch, and may transmit the coordinates to a host (not shown). The touch controller 2140 may be integrated with the display driving device 100 into one semiconductor chip.

Figure 15:
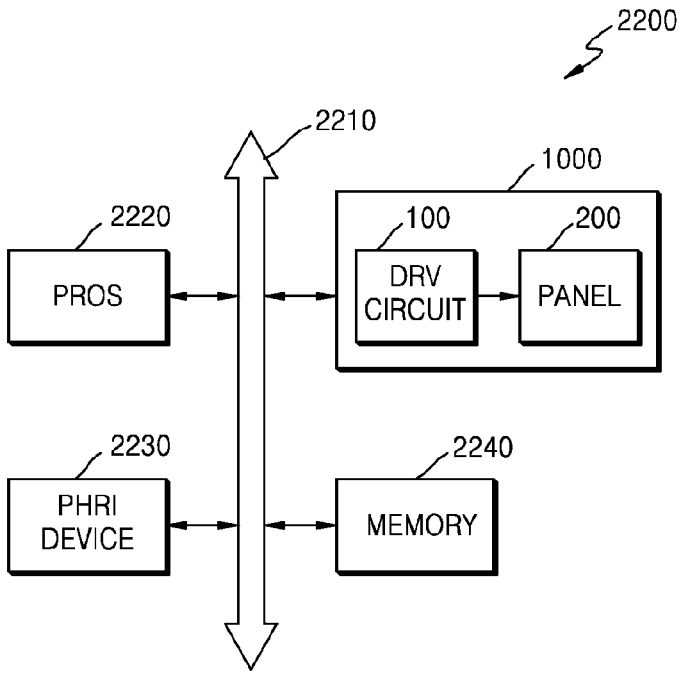
FIG. 15 is a block diagram of a display system according to an exemplary embodiment.

FIG. 15 is a block diagram of a display system 2200 according to an exemplary embodiment. Referring to FIG. 158, the display system 2200 may include a processor 2220, a display device 1000, a peripheral device 2230, and a memory 2240 that are electrically connected to a system bus 2210.

The processor 2220 may control data to be input/output to/from the peripheral device 2230, the memory 2240 and the display device 1000. The processor 2220 may perform image processing on image data transmitted among the peripheral device 2230, the memory 2240 and the display device 1000. The display device 1000 may include a display panel 200 and a display driving device 100. The display device 1000 may store image data that is applied via the system bus 2210 in a frame memory or a line memory included in the display driving device 100, and may display the image data on the display panel 200. The display device 1000 may be the display device 1000 of FIG. 1.

The peripheral device 2230 may be a device that converts a moving image or a still image into an electrical signal such as a camera, a scanner, or a webcam. Image data that is obtained by the peripheral device 2230 may be stored in the memory 2240, or may be displayed in real time on a panel of the display device 1000. The memory 2240 may include a volatile memory element such as dynamic random-access memory (DRAM) and/or a nonvolatile memory element such as a flash memory. Examples of the memory 2240 may include DRAM, phase change random-access memory (PRAM), magnetic random-access memory (MRAM), resistive random-access memory (ReRAM), ferroelectric random-access memory (FRAM), a NOR flash memory, a NAND flash memory, and a fusion flash memory (for example, a memory in which a static random-access memory (SRAM) buffer, a NAND flash memory, and a NOR interface logic are combined). The memory 2240 may store image data that is obtained from the peripheral device 2230 or may store an image signal that is processed by the processor 2220.

The display system 2200 may be provided in a mobile electronic device such as a tablet PC. However, the present exemplary embodiment is not limited thereto, and the display system 2200 may be provided in any of various electronic devices that may display an image.

Figure 16:
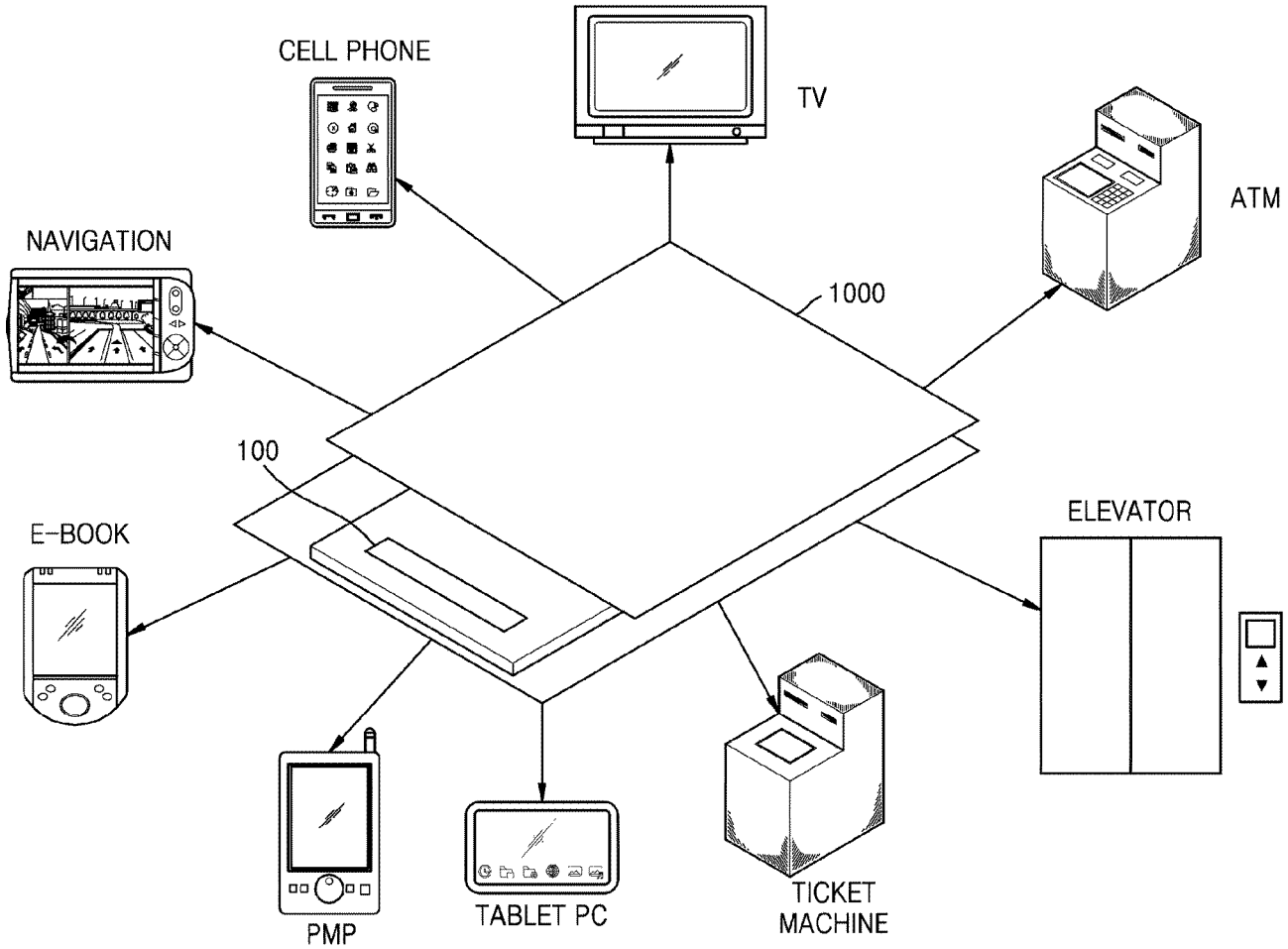
FIG. 16 is a view illustrating various electronic devices to which a display device according to an exemplary embodiment is applied, according to an exemplary embodiment.

FIG. 16 is a view illustrating various electronic devices to which the display device 1000 is applied, according to an exemplary embodiment. The display device 1000 may be provided to any of various electronic devices. The display device 1000 may be widely applied to a mobile phone, an automated teller machine (ATM) that automatically performs cash deposit and withdrawal at banks, an elevator, a ticket issuer that is used in a subway station or the like, a portable multimedia player (PMP), an e-book, a navigation system, and a tablet PC. The display device 1000 may include the display driving device 100 that may reduce power consumption and EMI. Accordingly, various electronic devices including the display device 1000 may accurately operate with low power consumption.

While the inventive concept has been particularly shown and described with reference to exemplary embodiments thereof, it will be understood that various changes in form and details may be made therein without departing from the spirit and scope of the following claims.

What is claimed is:

1. A display device comprising:

a display panel comprising a plurality of pixel arrangement areas, each of the plurality of arrangement areas comprising a plurality of pixels arranged in areas in which a plurality of gate lines intersect a plurality of data lines;

a data driving circuit comprising a plurality of source drivers, each of the plurality of source drivers being configured to output display data to data lines of corresponding pixels; and a timing controller configured to process input data from an external device and configured to generate output data, wherein the display panel is divided into the plurality of pixel arrangement areas based on a distance between the timing controller and each of the plurality of pixel arrangement areas, and wherein based on the divided display panel, the plurality of source drivers are classified into a plurality of driver groups such that one driver group corresponds to a respective pixel arrangement area from among the plurality of pixel arrangement areas;

wherein the timing controller is configured to transmit the output data to the data driving circuit such that the output data to a first source driver from among the plurality of source drivers are transmitted at a first transmission speed and the output data to a second source driver from among the plurality of source drivers are transmitted at a second transmission speed different from the first transmission speed.

2. The display device of claim 1, wherein the number of pixels, in each of the plurality of pixel arrangement areas, changes according to the distance between the timing controller and said each of the plurality of pixel arrangement areas.

3. The display device of claim 1, further comprising at least two transmission channels configured to transmit the output data from the timing controller to the data driving circuit, wherein a first transmission channel among the at least two transmission channels is configured to transmit the output data at the first transmission speed, and a second transmission channel among the at least two transmission channels is configured to transmit the output data at the second transmission speed.

4. The display device of claim 1, wherein the timing controller comprises at least two port output terminals configured to transmit the output data to the data driving circuit at different transmission speeds.

5. The display device of claim 1, wherein the plurality of pixel arrangement areas comprise a first pixel arrangement area and a second pixel arrangement area, and a vertical or horizontal distance between the timing controller and the first pixel arrangement area is shorter than a vertical or horizontal distance between the timing controller and the second pixel arrangement area.

6. The display device of claim 5, wherein the data driving circuit comprises:

a first source driver circuit comprising at least one source driver configured to output a first display data group corresponding to the first pixel arrangement area; and a second source driver circuit comprising at least one source driver configured to output a second display data group corresponding to the second pixel arrangement area, the first source driver circuit and the second source driver circuit being connected to the timing controller through a plurality of transmission channels.

7. The display device of claim 6, wherein the first transmission speed at which the timing controller transmits a first output data group to the first source driver circuit is higher than the second transmission speed at which the timing controller transmits a second output data group to the second source driver circuit.

8. The display device of claim 7, wherein the number of pixels of the first pixel arrangement area is greater than the number of pixels of the second pixel arrangement area, and the amount of data of the first output data group is greater than the amount of data of the second output data group.

9. The display device of claim 7, wherein the data driving circuit comprises an output data buffer configured to receive the output data from the timing controller, and the timing controller is configured to control timing so that the first output data group and the second output data group are simultaneously received by the output data buffer.

10. The display device of claim 7, wherein the timing controller comprises:

a first port output terminal configured to transmit the first output data group at the first transmission speed; and a second port output terminal configured to transmit the second output data group at the second transmission speed.

11. The display device of claim 10, wherein the number of electrical interconnection lines through which the first port output terminal is connected to the first source driver circuit is less than the number of electrical interconnection lines through which the second port output terminal is connected to the second source driver circuit.

12. A display driving device comprising:

a display panel comprising first and second pixel arrangement areas, each of the first and second pixel arrangement areas comprising a plurality of pixels arranged in areas in which a plurality of gate lines intersect a plurality of data lines;

a data driving circuit comprising a first source driver circuit configured to output a first display data group to a data line of the first pixel arrangement area, and a second source driver circuit configured to output a second display data group to a data line of the second pixel arrangement area;

a timing controller configured to array input data and configured to transmit output data to the data driving circuit at at least two preset transmission speeds corresponding to respective arrangement area from among the first and second pixel arrangement areas, the timing controller being configured to generate timing control signals;

a gate driving circuit configured to receive one of the timing control signals and configured to drive the plurality of gate lines of the display panel; and a voltage generating circuit configured to generate voltages for driving the display panel, wherein the display panel is divided into the first pixel arrangement area and the second pixel arrangement area and based on the divided display panel, the first source driver circuit outputs the first display data group to the data line of the first pixel arrangement area and the second source driver circuit outputs the second display data group to the data line of the second pixel arrangement area, and wherein the timing controller transmits the output data at said at least two transmission speeds which are different from each other based on the divided display panel.

13. The display driving device of claim 12, wherein a printed circuit board (PCB) with the first source driver circuit formed thereon is connected to a PCB with the second source driver circuit formed thereon through a bridge cable.

14. The display driving device of claim 12, wherein a vertical or horizontal distance from the timing controller to the first source driver circuit is shorter than a vertical or horizontal distance from the timing controller to the second source driver circuit.

15. The display driving device of claim 14, wherein the amount of data of the first display data group is greater than the amount of data of the second display data group.

16. The display driving device of claim 14, wherein the first source driver circuit comprises at least one first source driver configured to support a first transmission speed, the second source driver circuit comprises at least one second source driver configured to support a second transmission speed, and the first transmission speed is higher than the second transmission speed.

17. The display driving device of claim 16, wherein each of the at least one first source driver and the at least one second source driver comprises data line driving circuits, each of the data line driving circuits is connected to a data line of one of the plurality of pixels of the display panel, and is configured to provide the output data, and the number of data line driving circuits of the first source driver is greater than the number of data line driving circuits of the second source driver.

18. The display driving device of claim 14, wherein the number of pixels of the first pixel arrangement area is greater than the number of pixels of the second pixel arrangement area.

19. A display driving device comprising:

a display panel comprising first and second pixel arrangement areas, each of the first and second pixel arrangement areas comprising a plurality of pixels arranged in areas in which a plurality of gate lines intersect a plurality of data lines;

a data driving circuit comprising a first source driver circuit configured to output a first display data group to data lines of the first pixel arrangement area, and a second source driver circuit configured to output a second display data group to data lines of the second pixel arrangement area; and a timing controller configured to array data that is input from an external device, to transmit a first output data group to the first source driver circuit at a first preset transmission speed, and to transmit a second output data group to the second source driver circuit at a second preset transmission speed, wherein the first preset transmission speed is higher than the second preset transmission speed.

20. The display driving device of claim 19, wherein the first source driver circuit comprises a first output data buffer circuit configured to receive the first output data group, the second source driver circuit comprises a second output data buffer circuit configured to receive the second output data group, the amount of data of the first output data group is greater than the amount of data of the second output data group, and the timing controller is configured to control reception timing so that a time period at which the first output data buffer circuit receives the first output data group is the same as a time period at which the second output data buffer circuit receives the second output data group, and wherein the timing controller sets the first transmission speed and the second transmission speed based on at least one of a distance of a respective pixel arrangement area to the timing controller such that same amount of data is output in the first pixel arrangement area and the second pixel arrangement area.

* * * * *